US005206127A

United States Patent [19]

Ishigaki et al.

[11] Patent Number: 5,206,127

[45] Date of Patent: Apr. 27, 1993

[54] SILVER HALIDE PHOTOGRAPHIC MATERIAL

[75] Inventors: Kunio Ishigaki; Yuuzou Muramatsu, both of Kanagawa, Japan

[73] Assignee: Fuji Photo Film Co., Ltd., Kanagawa, Japan

[21] Appl. No.: 718,517

[22] Filed: Jun. 21, 1991

[30] Foreign Application Priority Data

Jun. 22, 1990 [JP] Japan ..... 2-165266

[51] Int. Cl.[5] ..... G03C 1/76

[52] U.S. Cl. ..... 430/523; 430/527; 430/539; 430/531; 430/950; 430/961; 430/496

[58] Field of Search ..... 430/523, 527, 539, 531, 430/950, 961, 496

[56] References Cited

U.S. PATENT DOCUMENTS

| | | | |
|---|---|---|---|
| 3,080,317 | 3/1963 | Tallet et al. | 430/401 |
| 4,004,927 | 1/1977 | Yamamoto et al. | 430/523 |
| 4,047,958 | 9/1977 | Yoneyama et al. | 430/527 |
| 4,675,278 | 6/1987 | Sugimoto et al. | 430/523 |
| 4,766,059 | 8/1988 | Vandenabeele et al. | 430/531 |
| 4,820,615 | 4/1989 | Vandenabeele et al. | 430/523 |
| 4,857,443 | 8/1989 | Aono et al. | 430/496 |
| 4,868,088 | 9/1989 | Aono et al. | 430/950 |
| 4,975,363 | 12/1990 | Cavallo et al. | 430/529 |

FOREIGN PATENT DOCUMENTS

| | | | |
|---|---|---|---|
| 0037710 | 2/1989 | Japan | 430/523 |

OTHER PUBLICATIONS

Perry, R. and Chilton, C., "Chemical Engineers' Handbook"; Fifth Edition, 1973, McGraw-Hill, pp. 23-62 and 23-63.

Research Disclosure, Item 23510, Nov., 1983.

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide photographic material is provide having at least one silver halide emulsion layer on one surface of a support and having on the other surface of the support, a backing layer containing a mat agent comprising grains having a mean grain size of 15 μm or more in a proportion of at least 5% by volume. Due to the presence of the particular mat agent, the material has improved feedability and has small amount of haze.

13 Claims, No Drawings

SILVER HALIDE PHOTOGRAPHIC MATERIAL

FIELD OF THE INVENTION

The present invention relates to a silver halide photographic material, and particularly to a photographic material having improved feedability.

BACKGROUND OF THE INVENTION

In the field of graphic arts, an image-formation system having super-hard photographic character is required to improve reproduction of images with continuous gradation of half-tone images or to improve reproduction of line images.

Previously, a particular developer known as a lith-developer has been utilized for the above purpose. A lith-developer contains only hydroquinone as a developing agent, in which a sulfite preservative is incorporated in the form of an adduct with formaldehyde in order not to interfere with the infectious developability thereof. Thus, the concentration of free sulfite ion in the developer is extremely low (generally, 0.1 mol/liter or less). Accordingly, the lith-developer is easily subjected to aerial oxidation and therefore has a serious defect in that it is not stable during storage for more than 3 days.

Known methods for obtaining high-contrast photographic characteristic by using a stable developer include using a hydrazine derivative, for example, as described in U.S. Pat. Nos. 4,224,401, 4,272,606, 4,211,857 and 4,243,739, and high-contrast systems using a tetrazolium derivative, for example, as described in JP-A-53-17719 and 61-117535. (The term "JP-A" as used herein means an "unexamined published Japanese patent application".)

Recently, scanner systems have become widely used in the field of photomechanical processing and printing technology. There are various known recording apparatus for image formation using such a scanner system. As a recording light source for this type of scanner system recording apparatus, a glow lamp, xenon lamp, tungsten lamp, LED, He-Ne laser, argon laser, semiconductor laser, etc are known.

Photographic materials which are applied to scanner systems of this type, must possess various photographic characteristics. In particular, the photographic materials are required to have high sensitivity and high contrast even under short time exposure, since they are only exposed from $10^{-7}$ to $10^{-3}$ seconds. Especially in the field facsimile machines, the photographic materials used therein must have rapid processability which is considered the most important characteristic in the field.

In the future, increasing the number of lines to be resolved as well as focusing the light beam to be irradiated would be required for the purpose of further accelerating scanning speed and further improving the quality of images to be reproduced. In this situation, development of photographic materials which have high sensitivity and high contrast and which may be developed and processed rapidly is strongly desired.

Further, various apparatus having an automatic feeding mechanism such as an automatic device for automatically feeding, exposing and developing photographic materials have been developed recently, and such automatic apparatus have been applied to a recording device used with the above-mentioned scanner system.

Where photographic materials are fed by the use of such an automatic feeding system, various feeding accidents often occur during the automatic processing. For example, photographic materials being processed can be erroneously trapped and stopped in the course of the processing line, or where large-sized sheet films are fed one by one from a sheet tray or stack zone, two or more sheets of them are erroneously fed (double-feeding).

As a means of improving the feedability of photographic materials being processed, there has been known a method of reducing the sliding friction of the materials. For instance, various techniques for this method are described in U.S. Pat. Nos. 3,042,522 and 3,080,317, and British Patents 1,466,304 and 1,143,118.

However, where photographic materials are processed with the more recent automatic processing machines equipped with a variety of feeding mechanisms as mentioned above, simply improving the slide property to the photographic materials being processed can not ensure sufficient feedability of the materials into the machine.

On the other hand, JP-A-60-188942, 60-188945 and 1-37710 disclose a system for improving the feedability of photographic materials by adding a mat agent to the backing layer of the support of the material, in which the mat agent containing grains having a grain size of 5 μm or more in a proportion of 30% or more by volume. However, the disclosed system is still not satisfactory, though it would be effective for improving the feedability of photographic materials being processed.

Additionally, it has been found that the disclosed system has a drawback. Specifically, since the mat agent contains large grains having a grain size of 5 μm or more in a proportion of 30% or more by volume, and therefore the volume of each grain in the agent is large, the number of grains present in the backing layer of the photographic material must be small even though the mat agent is incorporated into the backing layer of the material. As a result, when the material containing the agent is wound up on a roll, or a number of sheets of the material are piled up, the load to be applied to the unit area of the mat agent grain is so large that the mat agent grains in the layer can easily be crushed and broken out. Further, the system has been found to have another drawback. Specifically, when a mat agent comprising large grains is to be incorporated into a photographic material, the precipitation speed of the mat agent grains in the coating composition is large so that the content of the mat agent in the photographic material noticeably fluctuate in every manufacture lot of photographic materials.

SUMMARY OF THE INVENTION

One object of the present invention is to provide a silver halide photographic material having excellent feedability and having a small amount of haze.

Another object of the present invention is to provide a silver halide photographic material, which has an excellent feedability and is free of both dropping out of the mat agent from the material and free of stress marks caused by contact friction of the material with various substances. Accordingly, the material may be processed by rapid processing.

These and other objects of the present invention have been attained by providing a silver halide photographic material, which has at least one silver halide emulsion layer on one surface of a support and has a backing layer on the other surface of the support, in which the backing layer contains a mat agent containing grains having a grain size of 15 μm or more in a proportion of at least 5% by volume.

DETAILED DESCRIPTION OF THE INVENTION

The backing layer to be on one surface of the support of the present invention will now be explained in detail.

The backing layer contains a mat agent which is well known in the photographic technical field. The mat agent may be defined as having discontinuous solid grains of an inorganic or organic material which can be dispersed in a hydrophilic organic colloid binder. The mat agent may be either dissolved out or not dissolved out of the material during development.

Examples of inorganic mat agents usable in the present invention are oxides (for example, silicon dioxide, titanium oxide, magnesium oxide, aluminium oxide), alkaline earth metal salts (for example, sulfates or carbonates, such as barium sulfate, calcium carbonate, magnesium sulfate, strontium sulfate, calcium carbonate), silver halide grains that do not form images (for example, primitive grains, or grains that are desensitized with a rhodium salt or the like), and glass.

Additionally, inorganic mat agents as described in U.S. Pat. Nos. 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245 and 4,029,504 can also be used.

Examples of organic mat agents usable in the present invention are starch, cellulose esters (for example, cellulose acetate propionate), cellulose ethers (e.g., ethyl cellulose), gelatin, and synthetic resins. Examples of synthetic resins usable for the purpose are water-insoluble or hardly water-soluble synthetic polymers, such as those to be formed from monomer components of alkyl acrylates or methacrylates, alkoxyalkyl acrylates or methacrylates (the alkyl moiety and the alkoxyalkyl moiety in the above monomers generally having up to 30 carbon atoms and preferably up to 20 carbon atoms), glycidyl acrylates or methacrylates, acrylamides, methacrylamides, vinyl esters (e.g., vinyl acetate, vinyl cinnamate, vinyl butyrate), acrylonitriles, olefins (e.g., ethylene), styrenes, benzoguanamines, formaldehyde condensates, or mixtures of such monomer components, or of a combination of such monomers and additional monomers of acrylic acid, methacrylic acid, α,β-unsaturated dicarboxylic acids, hydroxyalkyl acrylates or methacrylates generally having the alkyl moiety of up to 5 carbon atoms and preferably from 2 to 4 carbon atoms, sulfoalkyl acrylates or methacrylates generally having the alkyl moiety of up to 5 carbon atoms and preferably from 2 to 4 carbon atoms, and/or styrenesulfonic acids.

Additionally, epoxy resins, nylons, polycarbonates, phenolic resins, polyvinyl carbazoles and polyvinylidene chlorides may also be used.

Further, organic mat agents as described in British Patent 1,055,713, U.S. Pat. Nos. 1,939,213, 2,221,873, 4,268,662, 2,322,037, 2,376,005, 2,391,181, 2,701,245, 3,079,257, 3,262,782, 3,443,946, 3,516,832, 3,539,344, 3,591,379 and 3,754,924, and JP-A-49-106821 and 57-14835 can also be used.

Further, mat agents which are dissolved out by development, such as those described in U.S. Pat. Nos. 4,142,894, 3,767,448 and 2,992,101, can also be used.

As mat agents for use in the present invention, especially preferred are spherical mat agents of water-dispersible vinyl polymers such as homopolymers of acrylates, e.g., methyl methacrylate, glycidyl acrylate or glycidyl methacrylate, or copolymers of such acrylates only or such acrylates and other vinyl monomers; as well as benzoguanamine/formaldehyde condensate polymers, for example, benzoguanamine resins of the formula:

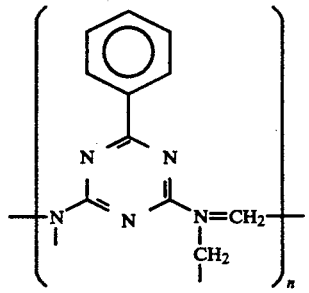

(n = 50,000 to 1,000,000)

such as Epostar (product by NIPPON SHOKUBAI KAGAKU KOGYO CO., LTD.), polyolefins (for example, Flowbead LE-1080, CL-2080 and HE-5023 (all products by Seitetsu Kagaku Co., Ltd.), and Chemipearl V-100 (product by Mitsui Petrochemical Industries, Ltd.)), and polystyrene bead, nylon bead, AS resin bead, epoxy resin bead, and polycarbonate resin beads (all products by MORITEKKUS).

As alkali-soluble mat agents, alkyl methacrylate/methacrylic acid copolymers described in JP-A-53-7231, 58-66937 and 60-8894, and alkali-soluble polymers having anionic groups described in JP-A-58-166341.

Additionally, mat agents having a narrow grain size distribution as described in JP-A-63-8736 and 61-230141 are advantageously used in the present invention.

For preparing mat agent grains having large grain size, which are used in the present invention, there may be employed, for example, a suspension polymerization method where an oil-soluble polymerization initiator is dissolved in monomers and such monomers are dropped into water in the presence of a small amount of a stabilizer to form polymerized grains as drops; and an emulsion-dispersion method where a non-crosslinked polymer is dissolved in an organic solvent and is dispersed in water in the presence of a stabilizer to form polymer grains. Precise control of the grain size distribution of the thus formed grains can be effected by classification such as sieving. The mat agent grains for use in the present invention, which are prepared by the above-described methods, have a mean grain size of from 10 to 16 μm.

Grains having a fluorine atom or silicon atom, such as those described in JP-A-62-14647, 62-17744 and 62-17743, may also be used in the present invention. Additionally, grains having reactive groups (especially, reactive with gelatin), such as those described in JP-A-64-77052 and European Patent 307,855, may also be used in the present invention.

As mentioned above, grains having various compositions can be used in the present invention. In order to more effectively exhibit the function of the mat agent grains, it is preferred to use grains having a hardness of $H_R$ M85 or more as a Rockwell hardness. "Rockwell hardness", as referred to herein, indicates a hardness based on the test method stipulated in ASTM D785.

Examples of materials having a hardness of $H_R$ M85 or more, include synthetic resins such as phenolic resin-molding materials, melamine resin-molding materials, urea resin-molding materials, polyester-cast materials, methacrylic materials, polyacetals, and nylon 66. Examples of materials having a hardness of less than $H_R$ M85, include synthetic resins such as polystyrenes, vinyl chloride, and polypropylenes. (See *Handbook of High Polymer Materials*, edited by Japan High Polymer Association and published by Corona Co., Japan.)

In order to more highly show the effect of the present invention, it is preferred to employ grains whose surfaces have been modified with an alkali. For modification of the surfaces of grains with an alkali for providing "grains whose surfaces have been modified with an alkali" as referred to herein, grains are dipped in an alkaline solution having a pH value of 10 or more for 10 minutes or more at 50° C. or higher, preferably in an alkaline solution having a pH value of 11 or more for 30 minutes or more at 50° C. or higher. After the treatment, the grains may be post-treated by neutralization with an acid or by washing with a large amount of water.

In accordance with the present invention, the above-mentioned mat agents can be used singly or in combination of two or more different kinds of agents.

In the present invention, the mat agent, containing grains having a grain size of 15 μm or more, preferably from 15 μm to 40 μm, in a proportion of 5% by volume or more, especially preferably from 7% by volume to 90% by volume, to all the grains in the agent, is selectively chosen from among- the above-mentioned mat agents.

In the present invention, the mat agent is incorporated into the backing layer preferably in an amount from 0.01 to 1 g/m$^2$, especially preferably from 0.02 to 0.5 g/m$^2$, per the support.

The "backing layer", as referred to herein, indicates all the layers formed on the surface of the support opposite to the surface coated with silver halide emulsion layers.

The backing layer may be composed of one layer or two or more layers, and the above-mentioned mat agent can be incorporated into any of the backing layers. The thickness of the backing layer is preferably from 0.5 μm to 10 μm, more preferable from 0.5 to 7 μm, which satisfactorily shows the effect of the present invention of improving the feedability of the photographic material.

In order to more effectively achieve the effect of the present invention, it is desired that the backing layer is composed of two or more plural layers, that an above-mentioned mat agent is incorporated into the layer below the outermost layer or to the nearer layer to the support than the outermost layer and that the total thickness of the layer(s) above the mat agent-containing layer is 1/10 or more, especially from ⅛ to ½, of the mean grain size of the mat agent grains.

In the present invention, it is preferred to incorporate a lubricant agent and/or a colloidal silica into the outermost layer of the backing layer.

The colloidal silica usable in the present invention is one consisting essentially of silicon dioxide and having a mean grain size of from 7 mμto 120 mμ, and it may further contain alumina or sodium aluminate as a minor constituent. In addition, the colloidal silica may also contain, as a stabilizer, an inorganic base such as sodium hydroxide, potassium hydroxide, lithium hydroxide or ammonia, or an organic base such as tetramethylammonium ion.

The details of the colloidal silica usable in the present invention are described in JP-A53-112732 and JP-B-57-9051 and 57-51653. (The term "JP-B" used herein means an examined published Japanese patent publication.)

As examples of colloidal silica usable in the present invention, there are commercial products such as Snowtex 20 ($SiO_2/Na_2O \geqq 57$), Snowtex 30 ($SiO_2/Na_2O \geqq 50$), Snowtex C ($SiO_2/Na_2O \geqq 100$), and Snowtex O ($SiO_2/Na_2O \geqq 500$) (all produced by Nissan Chemical Co., Japan). The ratio "$SiO_2/Na_2O$" for the products indicates the weight ratio of the content of silicon dioxide ($SiO_{02}$) to sodium hydroxide in each product where sodium hydroxide is expressed as $Na_2O$. These ratios are provided in the catalogs of these commercial products.

In the present invention, the preferred amount of colloidal silica, if any, is from 0.05 to 1.0 part by weight, more preferably from 0.2 to 0.5 par by weight, per part by weight of binder in the outermost layer as dry basis.

Specific examples of the lubricant usable in the present invention, include silicone lubricants as described in U.S. Pat. No. 3,042,522, British Patent 955,061, U.S. Pat. Nos. 3,080,317, 4,004,927, 4,047,958 and 3,489,567 and British Patent 1,143,118; higher fatty acid lubricants, alcohol lubricants and acid amide lubricants as described in U.S. Pat. Nos. 2,454,043, 2,732,305, 2,976,148 and 3,206,311 and German Patents 1,284,295 and 1,284,294; metal soaps as described in British Patent 1,263,722 and U.S. Pat. No. 3,933,516; ester lubricants and ether lubricants as described in U.S. Pat. Nos. 2,588,765 and 3,121,060 and British Patent 1,198,387; and taurine lubricants described in U.S. Pat. Nos. 3,502,473 and 3,042,222.

Preferred lubricants for use in the present invention, are alkylpolysiloxanes represented by the following formula (I), (II) or (III) as well as liquid paraffin which is liquid at room temperature:

(I)

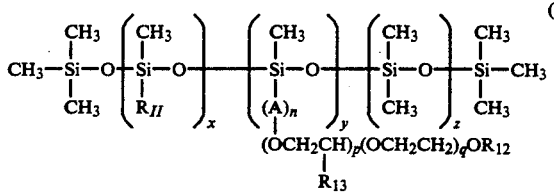

(II)

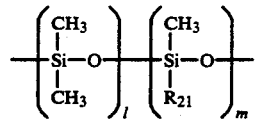

(III)

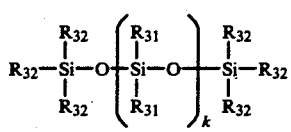

In formula (I), $R_{11}$ represents an aliphatic group such as an alkyl group preferably having from 1 to 18 carbon atoms, a substituted alkyl group preferably having 2 to 20 carbon atom (for example, an aralkyl group, an alkoxyalkyl group, an aryloxyalkyl group), or an aryl group (for example, a phenyl group); R12 represents a hydrogen atom, an aliphatic group such as an alkyl group preferably having from 1 to 12 carbon atoms, or a substituted alkyl group preferably having from 2 to 20 carbon atoms, or an aryl group (for example, a phenyl group); $R_{13}$ represents an alkyl group preferably having 1 to 18 carbon atoms (for example, a methyl group), or an alkoxyalkyl group preferably having from 2 to 20 carbon atoms (for example, a methoxymethyl group); A represents a divalent aliphatic hydrocarbon residue preferably having from 1 to 10 carbon atoms; n represents 0 or an integer from 1 to 12; p represents 0 or an integer from 1 to 50; q represents an integer of from 2 to 50 and preferably from 2 to 30; x represents 0 or an integer of from 1 to 100; y represents an integer of from 1 to 50; z represents 0 or an integer from 1 to 100; and (x+y+z) is an integer of from 5 to 250, preferably from 10 to 50.

Examples of $R_{11}$ include methyl, ethyl, propyl, pentyl, cyclopentyl, cyclohexyl, diethylpentyl, heptyl, methylhexyl, octyl, dodecyl, octadecyl, phenylethyl, methylphenylethyl, phenylpropyl, cyclohexylpropyl, benzyloxypropyl, phenoxypropyl, ethyloxypropyl, butyloxyethyl and phenyl groups.

Examples of A include methylene, 1-one-trimethylene and 2-methyl-1-one-trimethylene groups.

Examples of the alkyl group of $R_{12}$ include methyl, ethyl, propyl, butyl, amyl, hexyl, heptyl, octyl, nonyl, decyl and dodecyl groups.

In formula (II), $R_{21}$ represents an alkyl, cycloalkyl, alkoxyalkyl, arylalkyl, aryloxyalkyl or glycidyloxyalkyl group having from 5 to 20 carbon atoms; l represents 0 or an integer of 1 or more; m represents an integer of 1 or more; and (l+m) is an integer of from 1 to 1000, preferably from 2 to 500.

Formula (II) includes cyclic siloxanes having siloxane units represented by the following formula (IIa) and linear siloxanes having terminal groups represented by the following formula (IIb).

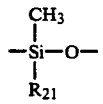
(IIa)

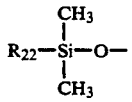
(IIb)

In formula (IIb), $R_{22}$ represents an alkyl group having from 1 to 20 carbon atoms, or a cycloalkyl, alkoxyalkyl, arylalkyl, aryloxyalkyl or glycidyloxyalkyl group having from 5 to 20 carbon atoms.

Examples of $R_{21}$ in formula (II) include pentyl, methylpentyl, cyclopentyl, cyclohexyl, dimethylpentyl, heptyl, methylhexyl, octyl, eicosyl, phenylethyl, methylphenylethyl, phenylpropyl, cyclohexylpropyl, benzyloxypropyl, phenoxypropyl, tolyloxypropyl, naphthylpropyl, ethyloxypropyl, butyloxyethyl, octadecyloxypropyl, glycidyloxypropyland glycidyloxybutyl groups.

In formula (III), $R_{31}$ represents an alkyl group having from 1 to 3 carbon atoms; $R_{32}$ represents an alkyl group having from 1 to 3 carbon atoms or an alkoxy group having 1 or 2 carbon atoms; and k represents 0 or an integer of from 1 to 2000.

Of these lubricants, more preferred lublicants are alkylpolysiloxanes having polyoxyalkylene side chain(s) represented by formula (I) as well as alkylpolysiloxanes represented by formula (II).

Specific examples of compounds of formula (I) are illustrated below, which, however, are not limitative.

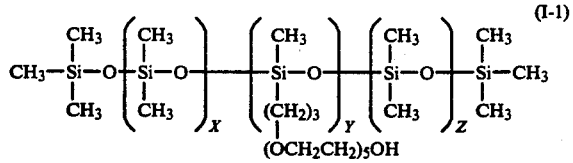
(I-1)

X + Y + Z = 30

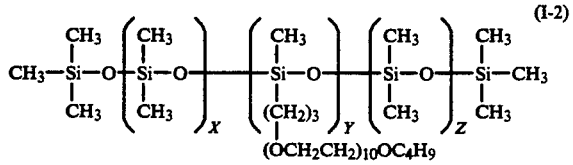
(I-2)

X + Y + Z = 40

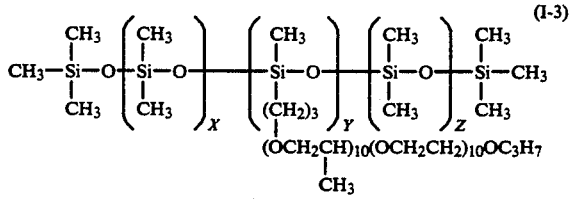
(I-3)

X + Y + Z = 35

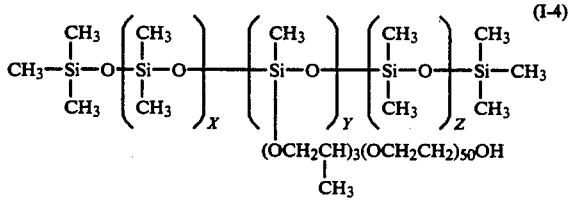
(I-4)

X + Y + Z = 50

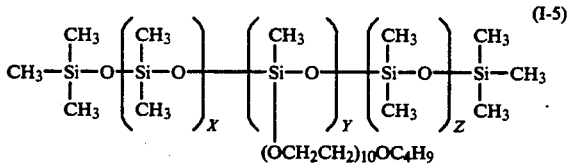
(I-5)

X + Y + Z = 100

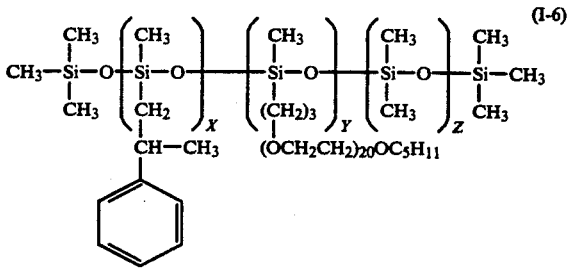
(I-6)

X + Y + Z = 40

Specific examples represented by compounds of formula (II) are illustrated below, which, however, are not limitative.

(II-1)

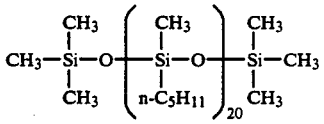

(II-2)

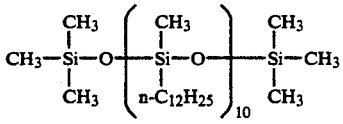

(II-3)

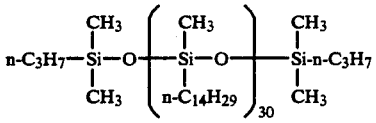

(II-4)

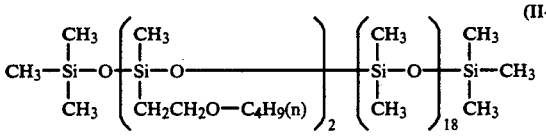

(II-5)

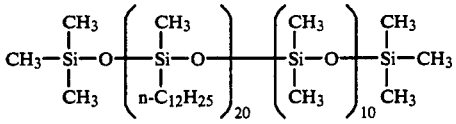

(II-6)

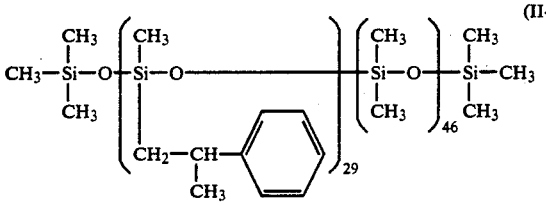

(II-7)

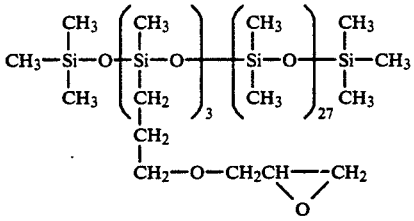

Specific examples of compounds represented by formula (III) are illustrated below, which, however, are not limitative.

(III-1)

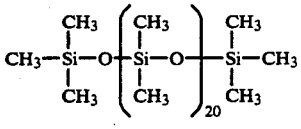

(III-2)

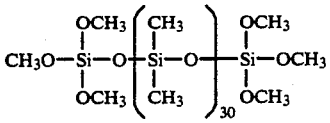

The amount of the lubricant to be coated is preferably from 0.005 to 1 g/m$^2$, especially preferably from 0.01 to 0.1 g/m$^2$.

In the present invention, an anionic surfactant represented by the following formula (IV) may also be added in the outermost layer of the backing layer:

(IV)

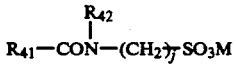

wherein $R_{41}$ represents a substituted or unsubstituted alkyl, alkenyl or aryl group having from 3 to 30 carbon atoms; $R_{42}$ represents a hydroxyl group, or a substituted or unsubstituted alkyl, alkenyl or aryl group having up to 10 carbon atoms; j represents an integer of from 2 to 6; and M represents a hydrogen atom, or an inorganic or organic cation.

Specific examples of anionic surfactants usable in the present invention are mentioned below, which, however, are not limitative.

$C_3H_7CONHCH_2CH_2SO_3Na$ (IV-1)

$C_9H_{19}CONHCH_2CH_2SO_3Na$ (IV-2)

$C_{17}H_{33}CONHCH_2CH_2SO_3Na$ (IV-3)

(IV-4)

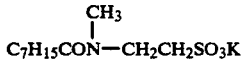

(IV-5)

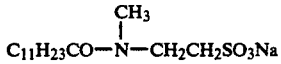

(IV-6)

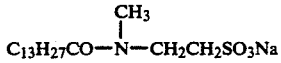

(IV-7)

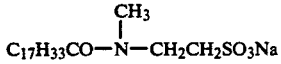

(IV-8)

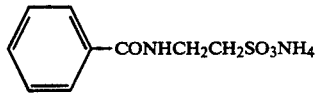

(IV-9)

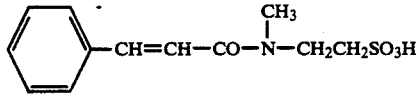

(IV-10)

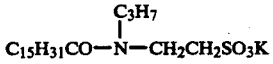

Where the anionic surfactant of formula (IV) is incorporated into the photographic material of the invention, the amount thereof is preferably from 0.001 to 0.5 g/m$^2$, especially preferably from 0.01 to 0.2 g/m$^2$.

In the photographic material of the invention, the backing layer may additionally contain other various additives, such as a hardening agent, a thickening agent, a pH adjusting agent, a surfactant, a charge-adjusting agent, an electroconductive polymer (e.g., metal oxides), and an antifoggant (e.g., development accelerator, development inhibitor), as well as various dyes for the purpose of prevention of halation, improvement of safelight stability and improvement of visual differentiation between the front surface from the back surface of the material.

As examples of dyes usable for these purposes, there are mentioned pyrazoloneoxonol dyes described in U.S.

Pat. No. 2,274,782; diarylazo dyes described in U.S. Pat. No. 2,956,879; styryl dyes and butadienyl dyes described in U.S. Pat. Nos. 3,423,207 and 3,384,487; merocyanine dyes described in U.S. Pat. No. 2,527,583; merocyanine dyes and oxonol dyes described in U.S. Pat. Nos. 3,486,897, 3,652,284 and 3,718,472; enaminohemioxonol dyes described in U.S. Pat. No. 3,976,661; and dyes described in British Patents 584,609 and 1,177,429, JP-A-48-85130, 49-99620 and 49-114420, and U.S. Pat. Nos 2,533,472, 3,148,187, 3,177,078, 3,247,127, 3,540,887, 3,575,704 and 3,653,905.

It is preferred that the photographic material of the invention contains a tetrazolium compound or a hydrazine derivative in the emulsion layer(s) and/or adjacent layer(s) thereof.

Preferred examples of tetrazolium compounds usable in the present invention are described, for example, in JP-A-53-17719, 53-17720, 53-95618, 58-186740 and 61-117535. Especially preferred are the following compounds.

(1) 2-(Benzothiazol-2-yl)-3-phenyl-5-dodecyl-2H-tetrazolium bromide
(2) 2,3-Diphenyl-5-(4-t-octyloxyphenyl)-2H-tetrazolium chloride
(3) 2,3,5-Triphenyl-2H-tetrazolium
(4) 2,3,5-Tri(p-carboxyethylphenyl)-2H-tetrazolium
(5) 2-(Benzothiazol-2-yl)-3-phenyl-5-(o-chlorophenyl)-2H-tetrazolium The amount of the tetrazolium compound to be used in the present invention, if any, is desirably from $1\times10^{-3}$ to $5\times10^{-2}$ mol per mol of silver halide.

Preferred examples of hydrazine derivatives usable in the present invention are compounds represented by the following general formula (V):

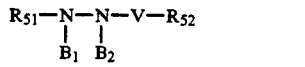

$$R_{51}-\underset{\underset{B_1}{|}}{N}-\underset{\underset{B_2}{|}}{N}-V-R_{52} \qquad (V)$$

wherein $R_{51}$ represents an aliphatic group or an aromatic group; $R_{52}$ represents a hydrogen atom, an alkyl group, an aryl group, an alkoxy group, an aryloxy group, an amino group, or a hydrazino group; V represents —CO— group, —$SO_2$— group, —SO— group, —PO($R_{53}$)— group, a —CO—CO— group, a thiocarbonyl group or an iminomethylene group; $R_{53}$ represents the groups defined for $R_{52}$; both $B_1$ and $B_2$ are hydrogen atoms, or one of them represents a hydrogen atom and the other represents a substituted or unsubstituted alkylsulfonyl group, or a substituted or unsubstituted arylsulfonyl group, or a substituted or unsubstituted acyl group.

In formula (V), the aliphatic group of $R_{51}$ is preferably one having from 1 to 30 carbon atoms and is especially preferably a linear, branched or cyclic alkyl group having from 1 to 20 carbon atoms. The alkyl group may optionally have substituent(s).

In formula (V), the aromatic group of $R_{51}$ is preferably a monocyclic or bicyclic aryl group or an unsaturated heterocyclic group. The unsaturated heterocyclic group may be condensed with an aryl group to form a condensed ring system.

More preferably, $R_{51}$ is an aryl group, especially preferably one containing benzene ring(s).

The aliphatic group and aromatic group of $R_{51}$ may optionally be substituted; and specific examples of substituents applicable to the group include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkyl- or arylthio group, an alkyl- or arylsulfonyl group, an alkyl- or arylsulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphoric acid amido group, a diacylamino group, an imido group, and $R_{52}$—NHCON($R_{52}$)—CO— group. Preferred examples of such substituents are an alkyl group preferably having from 1 to 20 carbon atoms, an aralkyl group preferably having from 7 to 30 carbon atoms, an alkoxy group preferably having from 1 to 20 carbon atoms, a substituted amino group preferably substituted by alkyl group(s) having from 1 to 20 carbon atoms, an acylamino group preferably having from 2 to 30 carbon atoms, a sulfonamido group preferably having from 1 to 30 carbon atoms, a ureido group preferably having from 1 to 30 carbon atoms, and a phosphoric acid amido group preferably having from 1 to 30 carbon atoms.

In formula (V), the alkyl group of $R_{52}$ is preferably one having from 1 to 4 carbon atoms; and the aryl group of $R_{52}$ is preferably a monocyclic or bicyclic aryl group (for example, one containing benzene ring(s)).

When V is —CO—, $R_{52}$ is preferably a hydrogen atom, an alkyl group (for example, methyl, trifluromethyl, 3-hydroxypropyl, 3-methanesulfonamidopropyl, phenylsulfonylmethyl), an aralkyl group (for example, o-hydroxybenzyl), or an aryl group (for example, phenyl, 3,5-dichlorophenyl, o-methanesulfonamidophenyl, 4-methanesulfonylphenyl, 2-hydroxymehtylphenyl); and it is especially preferably a hydrogen atom.

$R_{52}$ may optionally be substituted with, for example, the substituents mentioned for $R_5$ above.

In formula (V), V is most preferably —CO—.

Additionally, $R_{52}$ may be a group capable of cleaving the —V—$R_{52}$ moiety from the remaining molecule to cause cyclization and form a cyclic structure containing atoms of the —V—$R_{52}$ moiety. Examples of such a group are described, for example, in JP-A-63-29751.

$B_1$ and $B_2$ are most preferably hydrogen atoms.

In formula (V), $R_{51}$ or $R_{52}$ may contain a ballast group or a polymer group, which is generally combined with passive photographic additives such as couplers. The ballast group is a group which has 8 or more carbon atoms and is relatively inactive to photographic properties. For instance, it may be selected from an alkyl group, an alkoxy group, a phenyl group, an alkylphenyl group, a phenoxy group, and an alkylphenoxy group. Examples of polymers usable for this purpose, are mentioned, for example, in JP-A-1-100530.

In formula (V), $R_{51}$ or $R_{52}$ may have a group which enhances adsorbability of the molecule to the surfaces of silver halide grains by combining therewith. Examples of such adsorbing groups are a thiourea group, a heterocyclic thioamido group, a mercapto-heterocyclic group, and a triazole group, such as those described in U.S. Pat. Nos. 4,385,108 and 4,459,347, JP-A-59-195233, 59-200231, 59-201045, 59-201046, 59-201047, 59-201048, 59-201049, 61-170733, 61-270744, 62-948, 63-234244, and 63-234246, and Japanese Patent Application No 62-67501.

Specific examples of compounds represented by formula (V) are illustrated below, which, however, are not intended to restrict the scope of the present invention.

V-1
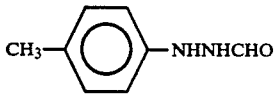
V-2
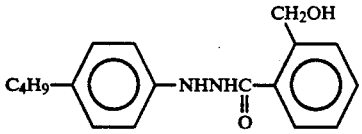
V-3
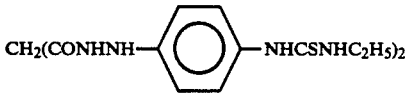
V-4
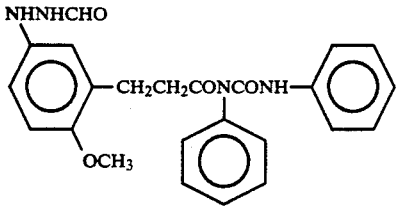
V-5
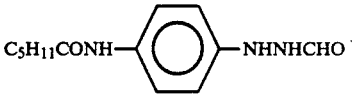
V-6
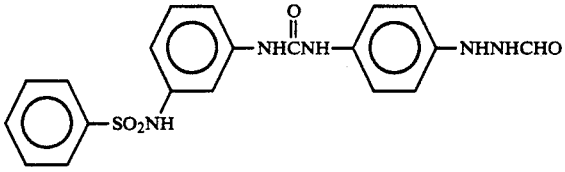
V-7
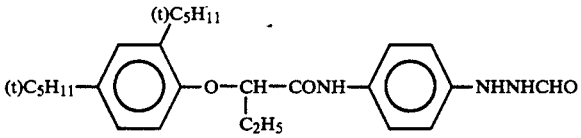
V-8
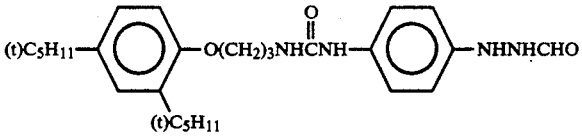
V-9
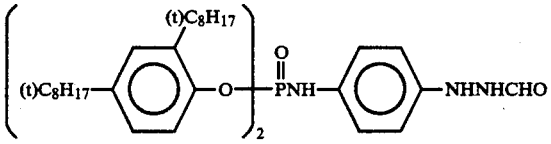
V-10
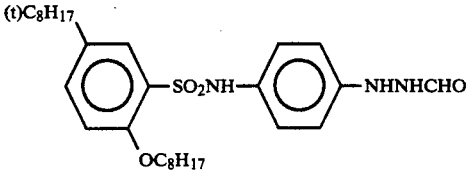

-continued
V-11
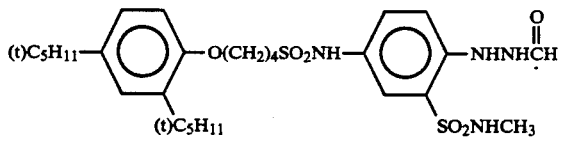
V-12
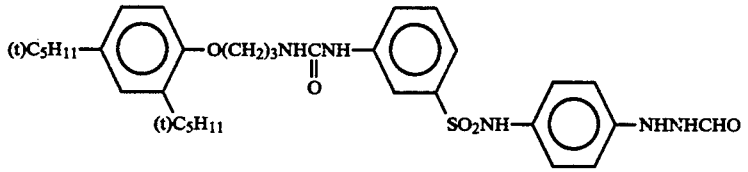
V-13
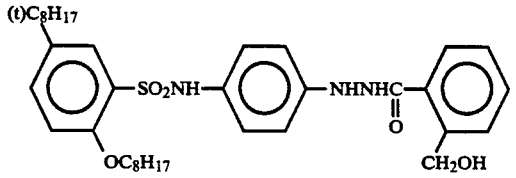
V-14
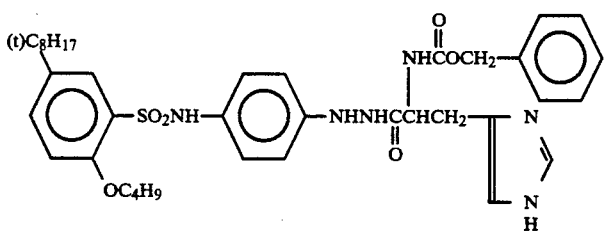
V-15
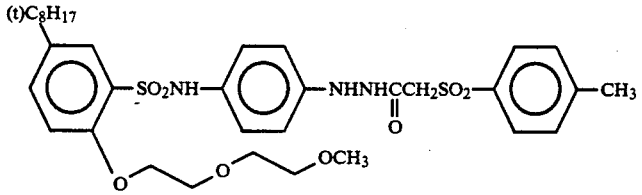
V-16
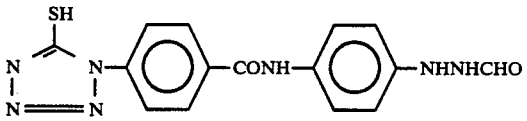
V-17
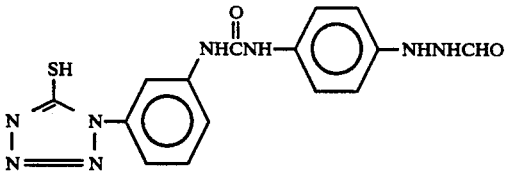
V-18
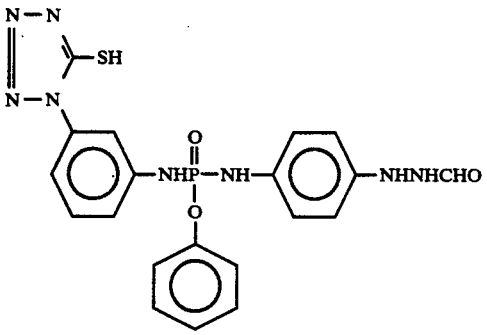

-continued
V-19
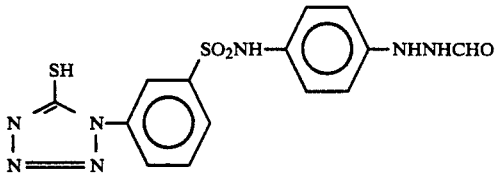
V-20
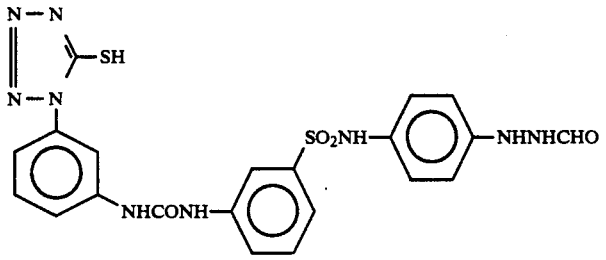
V-21
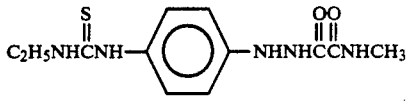
V-22
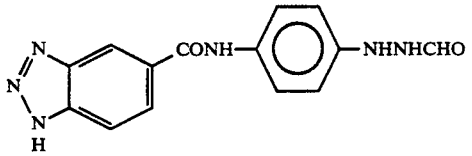
V-23
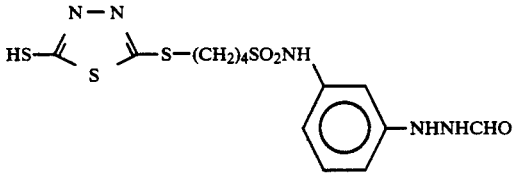
V-24
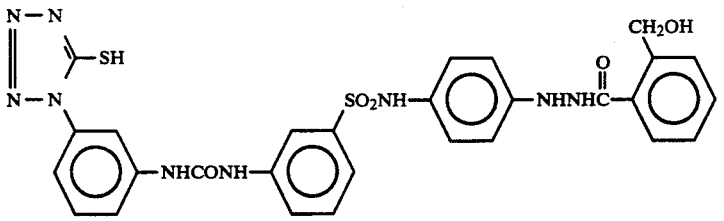
V-25
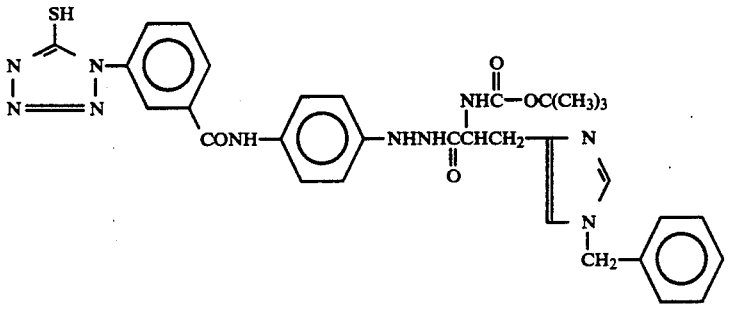

-continued

V-26

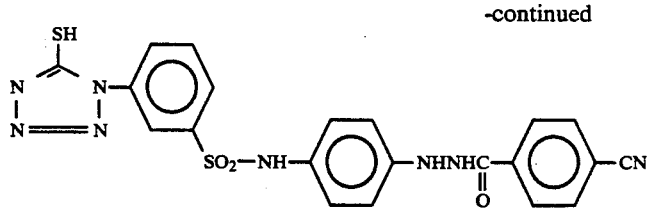

Further examples of hydrazine derivatives usable in the present invention, in addition to the above-mentioned compounds, include compounds described in Research Disclosure, Item 23510 (November, 1983, page 346) and literature referred to therein, as well as compounds described in U.S. Pat. Nos. 4,080,207, 4,269,929, 4,276,364, 4,278,748, 4,385,108, 4,459,347, 4,560,638, and 4,478,928, British Patent 2,011,391B, JP-A-60-179734, 62-270948, 63-29751, 61-170733, 61-270744 and 62-948, European Patent 217,310, U.S. Pat. No. 4,686,167, JP-A-62-178246, 63-32538, 63-104047, 63-121838, 63-129337, 63-223744, 63-234244, 63-234245, 63-234246, 63-294552, 63-306438, 1-100530, 1-105941, 1-105943, 64-10233, 1-90439, 1-276128, 1-283548, 1-280747, 1-283549, 1-285940, 2-2541 and 2-77057, and Japanese Patent Application Nos. 63-179760, 1-18377, 1-18378, 1-18379, 1-15755, 1-16814, 1-40792, 1-42615, 1-42616, 1-123693 and 1-126284.

Where such a hydrazine derivative is added to the photographic material of the invention, the amount of the derivative added is preferably from $1\times10^{-6}$ to $5\times10^{-2}$ mol, especially preferably from $1\times10^{-5}$ to $2\times10^{-2}$ mol, per mol of silver halide.

It is also preferred to add a polyhydroxybenzene compound to the photographic material of the present invention for improving pressure-resistance and for improving storage stability without lowering the sensitivity of the material. Preferred examples of such a polyhydroxybenzene compound usable in the present invention include those represented by the following formulae (VIa), (VIb) and (VIc).

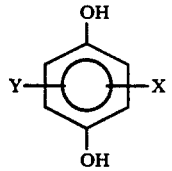

(VIa)

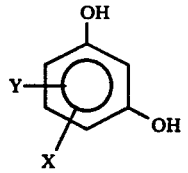

(VIb)

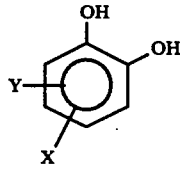

(VIc)

In these formulae, X and Y each represent —H, —OH, a halogen atom, —OM' (where M' is an alkali metal ion), an alkyl group, a phenyl group, an amino group, a carbonyl group, a sulfone group, a sulfonated phenyl group, a sulfonated alkyl group, a sulfonated amino group, a sulfonated carbonyl group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

More preferably, X and Y each are —H, —OH, —Cl, —Br, —COOH, $—CH_2CH_2COOH$, $—CH_3$, $—CH_2CH_3$, $—CH(CH_3)2$, $-C(CH3)_3$, —OCH3, —CHO, $—SO_3Na$, $—SO_3H$, $—SCH_3$,

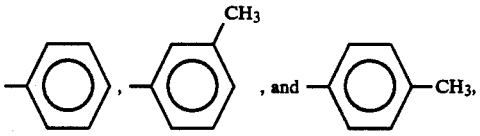

X and Y may be the same as or different from each other.

Especially preferred examples of polyhydroxybenzene compounds usable in the present invention are mentioned below, which, however, are not limitative.

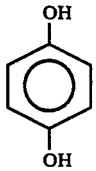

VI-(1)

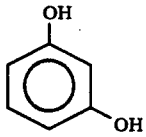

VI-(2)

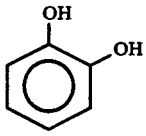

VI-(3)

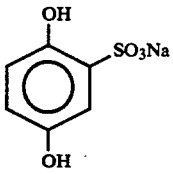

VI-(4)

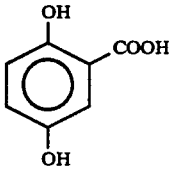

VI-(5)

-continued

VI-(6)

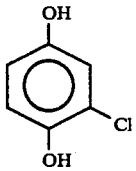

VI-(7)

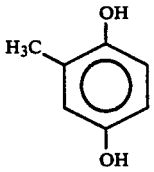

VI-(8)

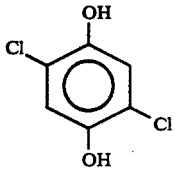

VI-(9)

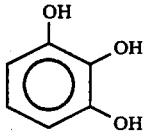

VI-(10)

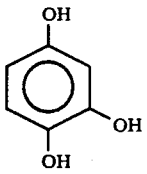

VI-(11)

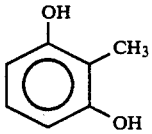

VI-(12)

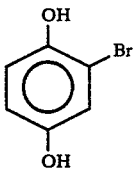

VI-(13)

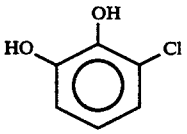

VI-(14)

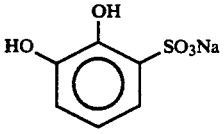

VI-(15)

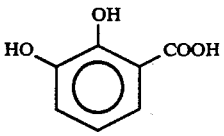

-continued

VI-(16)

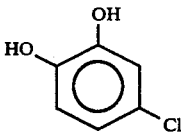

VI-(17)

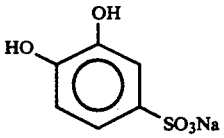

VI-(18)

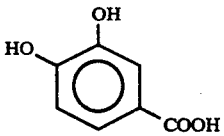

VI-(19)

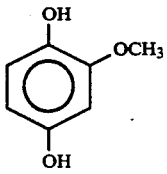

VI-(20)

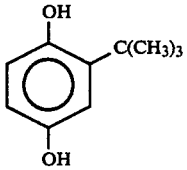

VI-(21)

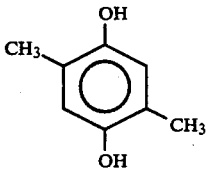

VI-(22)

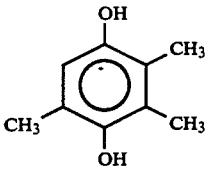

In the present invention, a suitable polyhydroxybenzene compound can be added to the emulsion layer or to any other layer in the photographic material. The amount of the compound to be added may be preferably from $1\times10^{-5}$ mol to 1 mol, more preferably from $1\times10^{-3}$ mol to $1\times10^{-1}$ mol, per mol of silver halide.

The light-sensitive silver halide emulsion used in the photographic material of the present invention can be spectrally sensitized to be sensitive to blue light, green light, red light or infrared light having a relatively long wavelength. Suitable sensitizing dyes usable for such spectral sensitization are, for example, cyanine dyes, merocyanine dyes, complex cyanine dyes, complex merocyanine dyes, holopolar cyanine dyes, styryl dyes, hemicyanine dyes, oxonol dyes, and hemioxonol dyes.

Examples of sensitizing dyes usable in the present invention are described, for example, in *Research Disclosure,* Item 17643, IV-A (December, 1978, page 23) and Ibid., Item 1831 X, (August, 1979, page 437) or in references referred to in these disclosures.

In particular, sensitizing dyes having a color sensitivity suitable to the spectral characteristics of various scanner light sources applicable to the photographic materials of the present invention are advantageously selected for the respective light sources.

For instance, (A) simple merocyanine dyes described in JP-A-60-162247 and 2-48653, U.S. Pat. No. 2,161,331 and German Patent 936,071 are advantageously selected to an argon laser ray source; (B) tri-cyclic cyanine dyes described in JP-A-50-62425, 54-18726 and 59-102229 to a helium-neon laser ray source; (C) thiacarbocyanine dyes described in JP-B-48-42172, 51-9609, 55-39818 and 62-284343 to an LED light source; and (D) tricarbocyanine dyes described in JP-A-59-191032 and 60-80841 and 4-quinoline nuclei-containing dicarbocyanine dyes described in JP-A-59-192242 to a semiconductor laser ray source.

Specific examples of sensitizing dyes usable in the present invention are mentioned below, which, however, are not limitative.

Examples of Compounds of Group (A):

A-1

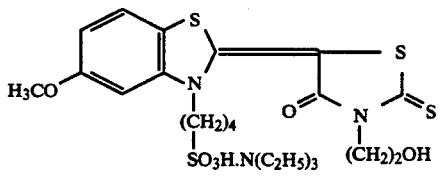

A-2

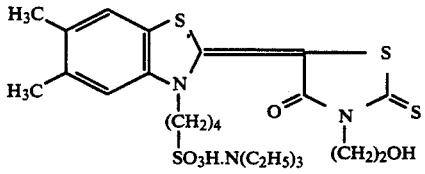

A-3

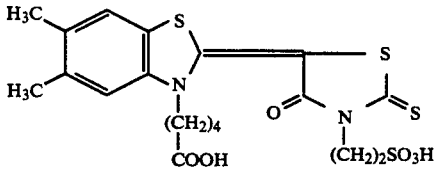

A-4

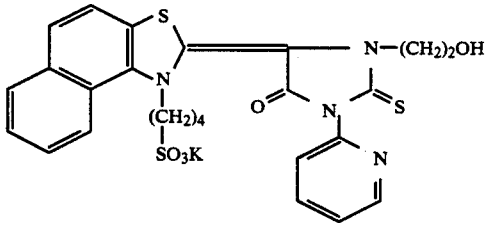

A-5

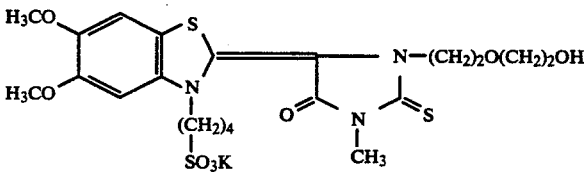

Examples of Compounds of Group (B):

B-1

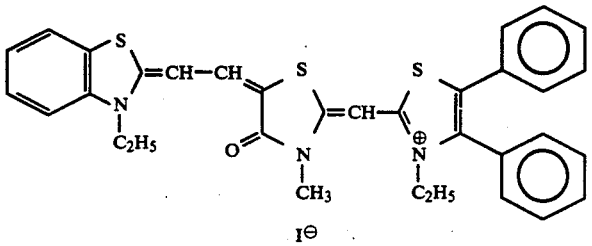

-continued

B-2

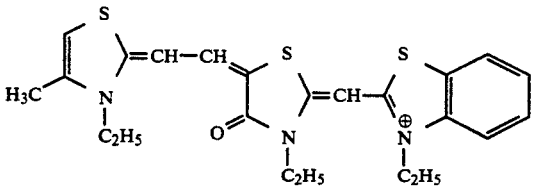

$I^{\ominus}$

B-3

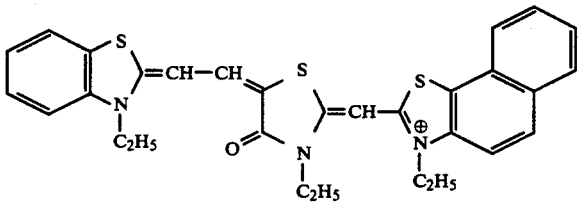

$I^{\ominus}$

B-4

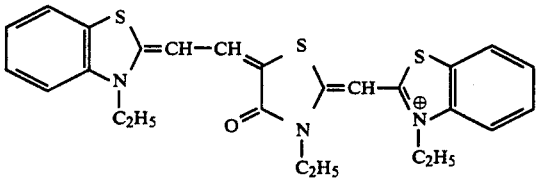

$I^{\ominus}$

Examples of Compounds of Group (C):

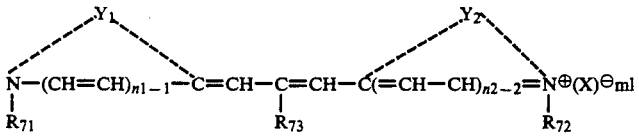

(VII)

where $Y_1$ and $Y_2$ each represent a non-metallic group necessary for forming a heterocyclic ring such as benzothiazole ring, benzoselenazole ring naphthothiazole ring, naphthoselenazole ring or quinoline ring, and the heterocyclic ring may optionally be substituted by substituent(s) selected from a lower alkyl group, an alkoxy group, a hydroxyl group, an aryl group, an alkoxycarbonyl group and a halogen atom; $R_{71}$ and $R_{72}$ each represent a lower alkyl group, a sulfo group, or a carboxyl group-having alkyl group; $R_{73}$ represents a lower alkyl group; $X_1$ represents an anion; $n_1$ and $n_2$ each represent 1 or 2; and $m_1$ represents 1 or 0, and when the formula is in the form of an internal salt, $m_1$ is 0.

Specific examples of compounds of formula (VII) are mentioned below.

C-1

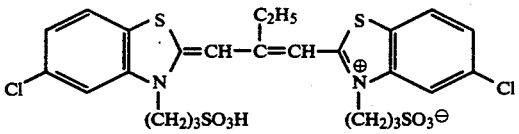

C-2

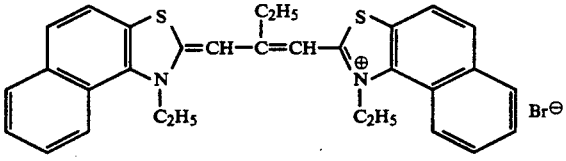

C-3

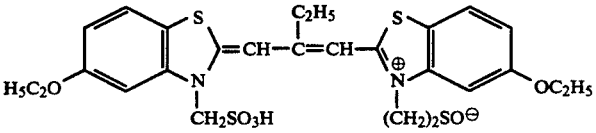

-continued
C-4
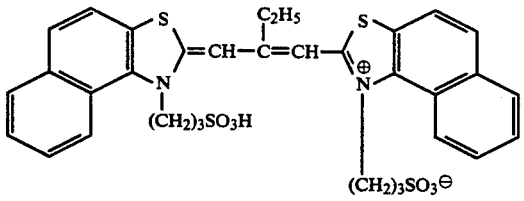
C-5
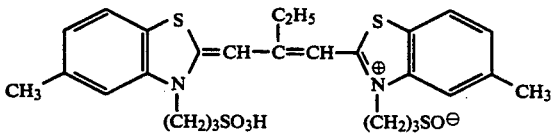
C-6
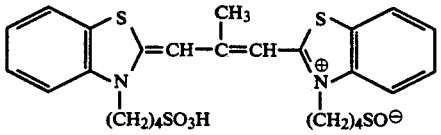
C-7
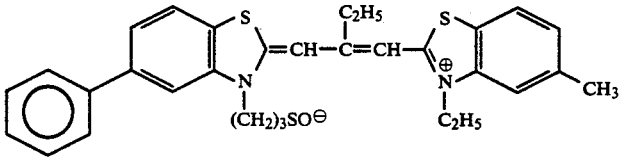
C-8
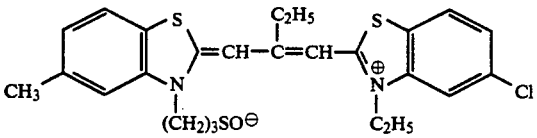
Examples of Compounds of Group (D):
D-1
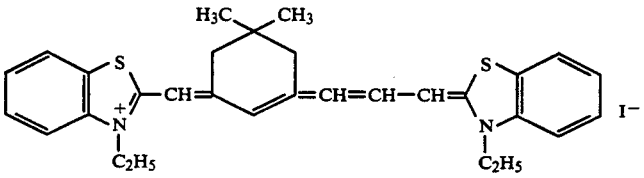
D-2
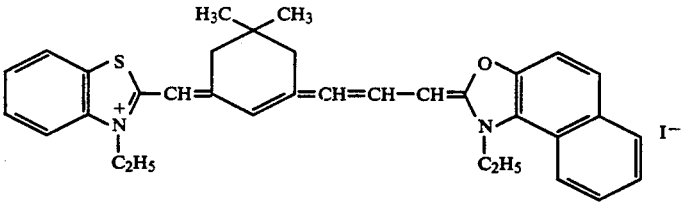
D-3
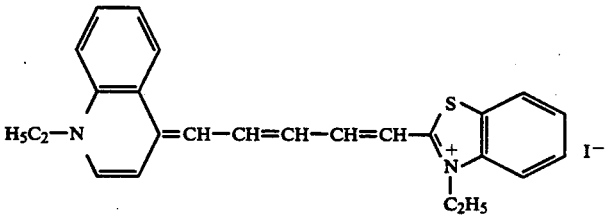
D-4
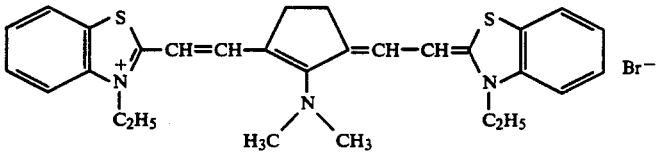

-continued

D-5

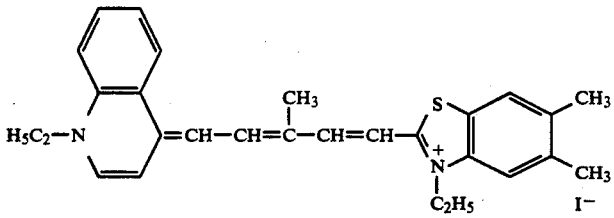

D-6

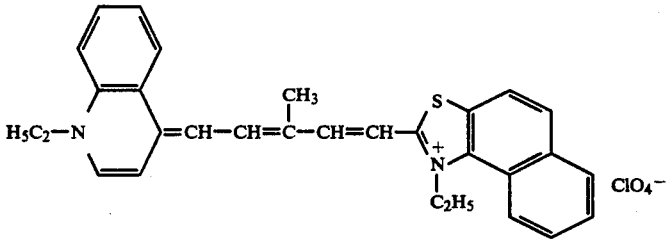

These sensitizing dyes can be incorporated into the photographic material of the present invention singly or in combination of two or more. A combination of sensitizing dyes is often used for the purpose of supersensitization. Together with such sensitizing dyes, dyes which do not have a sensitizing action by themselves or substances which do not substantially absorb visible rays but show supersensitization may be incorporated into the emulsion layers of the photographic material of the present invention.

Usable sensitizing dyes, combinations of dyes for supersensitization, and substances showing supersensitization are described in *Research Disclosure,* Vol. 176, Item No. 17643 (issued December, 1978, page 23, IV-J).

In the present invention, the content of the sensitizing dyes in the photographic material is optimally determined in accordance with the grain size of the silver halide grains in the emulsions of the material, the halogen composition of the grains, the method and degree of chemical sensitization of the emulsions, the relationship between the layer to which the dyes are to be added and the silver halide emulsion of the layer, and the kind of antifoggant added to the emulsion of the layer. The test method for selection of the optimum amount is well known by one skilled in the art. In general, the content of the dyes is preferably from $1\times10^{-7}$ mol to $1\times10^{-2}$ mol, especially preferably from $1\times10^{-6}$ mol to $5\times10^{-3}$ mol, per mol of silver halide.

The silver halide used in forming the photographic material of the present invention is not specifically defined by may be any of, for example, silver chloride, silver bromide, silver iodide, silver chlorobromide, silver chloroiodide, silver iodobromide and silver chloroiodobromide. Of these silver halides, silver chloroiodobromide, silver chlorobromide and silver iodobromide are preferred for use in the present invention. More preferably, silver chlorobromide or silver chloroiodobromide containing silver iodide in an amount of from 0 to 1 mol % is advantageously used.

The silver halide grains for use in the present invention are preferably fine grains having a means grain size of, for example, 0.7 $\mu$ or less, especially preferably 0.5 $\mu$ or less. The grain size distribution of the grains is not specifically defined, but the emulsion is desirably a monodisperse. "Monodisperse emulsion" as referred to herein indicates an emulsion in which at least 95% by weight or by number of the grains have a grain size falling within the range of the mean grain size plus/-minus 40%.

The silver halide grains in the photographic emulsion of the photographic material of the present invention may be regular crystalline grains such as cubic or octahedral grains or irregular crystalline grains such as spherical or tabular grains, or they may also be composite crystalline grains composed of such regular and irregular crystalline forms.

The silver halide grains may have a uniform phase throughout the grain or may have different phases in constituting the inside (core) and the surface layer (shell). Two or more different silver halide emulsion as separately prepared may be mixed and used in preparing the photographic material of the present invention.

The silver halide emulsion layer of the photographic material of the invention may be a single layer or may be composed of plural layers (such as two layers, three layers, etc.). Where the layer is composed of plural layers, either different silver halide emulsions or the same one may be used for forming such plural layers.

In preparing the silver halide emulsions for use in the present invention, a cadmium salt, a sulfite salt, a lead salt, a thallium salt, a rhodium salt or a complex salt thereof, or an iridium salt or a complex salt thereof may be added to the system of forming the silver halide grains or of physically ripening them.

It is preferred to add a water-soluble rhodium salt, especially typically rhodium chloride, rhodium trichloride or rhodium ammonium chloride, to the silver halide emulsions of the present invention. Complexes of such salts may also be used. The time of adding such a rhodium salt is defined to be prior to finish of the first ripening of the silver halide grains, in the step of preparing them. In particular, the salt is desired to be added during the course of forming the grains. The amount of the salt to be added is preferably from $1\times10^{-8}$ mol to $1\times10^{-6}$ mol per mol of silver.

Silver halides which are especially suitable for use in the present invention are prepared in the presence of an iridium salt or a complex salt thereof in an amount of from $10^{-8}$ to $10^{-5}$ mol per mol of silver.

Such an iridium salt in the above-mentioned amount is added to the system of forming silver halide grains prior to finishing the physical ripening of the grains, and especially during the course of formation of the grains.

The iridium salt used for this purpose is a water-soluble iridium salt or an iridium complex salt, which includes, for example, iridium trichloride, iridium tetrachloride, potassium hexachloroiridate(III), potassium hexachloroiridate(IV) and ammonium hexachloroiridate(III).

As a binder or protective colloid for the photographic emulsion, gelatin is advantageously used, but any other hydrophilic colloids may also be used. For instance, suitable colloids are proteins such as gelatin derivatives, graft polymers composed of gelatin and other high polymer substances, albumin and casein; cellulose derivatives such as hydroxyethyl cellulose, carboxymethyl cellulose and cellulose sulfates; saccharide derivatives such as sodium alginate and starch derivatives; as well as various synthetic hydrophilic high polymer substances of homopolymers or copolymers such as polyvinyl alcohol, polyvinyl alcohol partial acetal, poly-N-vinylpyrrolidone, polyacrylic acid, polymethacrylic acid, polyacrylamide, polyvinylimidazole or polyvinylpyrazole.

The silver halide emulsions for use in the present invention may or may not be chemically sensitized. For chemical sensitization of silver halide emulsions, there are known a sulfur sensitization method, a reduction sensitization method and a noble metal sensitization method. Any of such known methods can be employed for chemical sensitization of the silver halide emulsions to be used in the present invention, singly or in combination.

Of the noble metal sensitization method, gold sensitization is typical, where gold compounds especially gold complexes are used. In the noble sensitization method, complexes of any other noble metals, such as platinum, palladium or rhodium, may also be used.

Sulfur sensitizers usable for the sulfur sensitization method, are sulfur compounds contained in gelatin as well as other various sulfur compounds such as thiosulfates, thioureas, thiazoles and rhodanines.

Suitable reducing sensitizers for the reduction sensitization method include stannous salts, amines, formamidinesulfinic acids and silane compounds.

The photographic material of the present invention can contain compounds as described in JP-A-60-140340 and 61-167939 for the purpose of elevating the sensitivity and of hardening the contrast. Such compounds can be added to the material singly or in combination of two or more.

The photographic material of the present invention can contain various compounds for the purpose of preventing the materials from fogging during manufacture, storage or photographic processing thereof or for the purpose of stabilizing the photographic properties of the material. For instance, various compounds which are known as an antifoggant or stabilizer can be employed for this purpose, and these compounds include azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles; mercaptopyrimidines; mercaptotriazines; thioketo compounds such as oxazolinethione; azaindenes such as triazaindenes, tetrazaindenes (especially, 4-hydroxy-substituted (1,3,3a,7)-tetrazaindenes), pentazaindenes; as well as benzenethiosulfonic acids, benzenesulfinic acids and benzenesulfonic acid amides. Above all, benzotriazoles (for example, 5-methyl-benzotriazole) and nitroindazoles (for example, 5-nitroindazole) are preferred. The compounds may be added to the processing solutions for processing the photographic material.

The photographic emulsions and light-insensitive hydrophilic colloids of the photographic material of the present invention can contain an inorganic or organic gelatin-hardening agent. Hardening agents include, for example, active vinyl compounds (e.g., 1,3,5-triacryloylhexahydro-s-triazine, bis(vinylsulfonyl)methylether, N,N'-methylene-bis-[β-(vinylsulfonyl)propionamide]), active halogen compounds e.g., 2,4-dichloro-6-hydroxy-s-triazine), mucohalogenic acids (e.g., mucochloric acid), N-carbamoylpyridinium salts (e.g., (1-morphlinocarbonyl-3-pyridinio)methanesulfonate), and haloamidinium salts (e.g., 1-(1-chloro-1-pyridinomethylene)pyrrolidinium 2-naphthalenesulfonate). These can be used singly or in combination of two or more. Above all, active vinyl compounds described in JP-A-53-41220, 53-57257, 59-162546 and 60-80846, and active halogen compounds described in U.S. Pat. No. 3,325,287 are preferred.

The photographic emulsion layers and light-insensitive hydrophilic colloid layers of constituting the photographic material of the present invention can contain various surfactants for various purposes such as a coating aid, prevention of static charges, emulsification and dispersion aid, prevention of surface blocking and improvement of photographic characteristics (for example, improvement of developability, elevation of hard contrast, sensitization).

For instance, suitable examples are nonionic surfactants such as saponins (steroid saponins), alkylene oxide derivatives (e.g., polyethylene glycol, polyethylene glycol/polypropylene glycol condensate, polyethylene glycol alkyl ethers, polyethylene glycol alkylaryl ethers, polyethylene glycol esters, polyethylene glycol sorbitan esters, polyalkylene glycol alkylamines or amides, silicone-polyethylene oxide adducts), glycidol derivatives (e.g., alkenylsuccinic acid polyglycerides, alkylphenol polyglycerides), fatty acid esters of polyalcohols, and alkyl esters of saccharides; anionic surfactants having an acid group such as a carboxyl group, a sulfo group, a phospho group, a sulfate group or a phosphate group, for example, alkylcarboxylic acid salts, alkylsulfonic acid salts, alkylbenzenesulfonic acid salts, alkylnaphthalenesulfonic acid salts, alkyl sulfates, alkyl phosphates, N-acyl-N-alkyltaurins, sulfosuccinates, sulfoalkylpolyoxyethylene alkylphenyl ethers, and polyoxyethylene alkylphosphates; ampholytic surfactants such as amino acids, aminoalkylsulfonic acids, aminoalkyl sulfates or phosphates, alkybetains, and amine oxides; and cationic surfactants such as alkylamine salts, aliphatic or aromatic quaternary ammonium salts, heterocyclic quaternary ammonium salts such as pyridinium or imidazolium salts, and aliphatic or heterocyclic phosphonium or sulfonium salts.

The photographic material of the present invention can contain a mat agent such as silica, magnesium oxide or polymethyl methacrylate, in the photographic emulsion layers and hydrophilic colloid layers other than the backing layer, for the purpose of preventing surface blocking.

The photographic material of the present invention can contain a dispersion of a water-soluble or hardly water-soluble synthetic polymer, for the purpose of improving the dimension stability of the material. Suitable polymers include polymers composed of monomers of alkyl (meth)acrylates, alkoxyalkyl (meth)acrylates, glycidyl (meth)acrylates, (meth)acrylamides, vinyl esters (for example, vinyl acetate), acrylonitriles, olefins and styrenes singly (for homopolymers) or in combination thereof (for copolymers) or composed of such monomers and other comonomers of acrylic acid, methacrylic acids, $\alpha,\beta$-unsaturated dicarboxylic acids, hydroxyalkyl (meth) acrylates, sulfoalkyl (meth)acrylates and/or styrenesulfonic acids (for copolymers).

Suitable supports for the photographic material of the present invention are cellulose triacetate, cellulose diacetate, nitrocellulose, polystyrene, and polyethylene terephthalate. Most preferred is a polyethylene terephthalate film.

The support may be corona-treated by a known method, or if desired, it may be subbed by a known method.

For the purpose of improving the dimensional stability of the material for preventing fluctuation of the dimension of the material by variation of the ambient temperature or moisture, a water-proof layer containing a polyvinylidene chloride polymer may also be provided on the surface of the support.

As development accelerators suitable for use in the present invention or accelerators for nucleating infectious development, compounds described in JP-A-53-77616, 54-37732, 53-137133, 60-140340 and 60-14959 as well as other various compounds containing N and/or S atom(s) are effective.

It is preferred that the photographic material of the present invention contains an acid group-having compound in the silver halide emulsion layers and other layers of the material. Examples of such acid group-having compounds, are organic acids such as salicylic acid, acetic acid and ascorbic acid as well as polymers or copolymers having repeating units derived from acid monomers such as acrylic acid, maleic acid or phthalic acid. The details of such compounds are described in JP-A-61-223834, 61-228437, 62-25745, 62-55642 and 62-220947. Of these compounds, especially preferred are ascorbic acid as a low molecular compound and a water-dispersing latex of a copolymer composed of an acid monomer such as acrylic acid and a crosslinking monomer having two or more unsaturated groups such as divinyl benzene as a high polymer compound.

For obtaining ultra-hard and high-sensitive photographic images by processing the photographic material of the present invention, known infectious developers or high-alkali developers having a pH value of about 13 as described in U.S. Pat. No. 2,419,975 are unnecessary, but any other stable developers can be used.

Specifically, the silver halide photographic material of the present invention may well be processed with a developer containing a sulfite ion as a preservative in an amount of 0.15 mol/liter or more and having a pH value of from 10.5 to 12.3, especially from 11.0 to 12.0, whereby sufficiently ultra-hard negative images can be obtained.

The developing agent in the developer used for processing the photographic material of the present invention is not specifically defined, but dihydroxybenzenes are preferred as easily providing good half-tone dot image quality. A combination of dihydroxybenzenes and 1-phenyl-3-pyrazolidones or a combination of dihydroxybenzenes and p-aminophenols may also be used.

Examples of dihydroxybenzenes usable as a developing agent for processing the photographic materials of the present invention are hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Especially preferred is hydroquinone.

Examples of 1-phenyl-3-pyrazolidone and derivatives thereof usable as a developing agent in the present invention are 1-phenyl-3-pyrazolidone, 1-phenyl-4,4-dimethyl-4-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

Examples of p-aminophenols usable as a developing agent in the present invention are N-methyl-p-aminophenol, p-aminophenol, N-($\beta$-hydroxyethyl)-p-aminophenol, N-(4-hydroxyphenyl)glycine, 2-methyl-p-aminophenol, and p-benzylaminophenol. Above all, especially preferred is N-methyl-p-aminophenol.

The amount of the developing agent to be in the developer for processing the photographic material of the present invention is preferably generally from 0.05 mol/liter to 0.8 mol/liter. Where a combination of dihydroxybenzenes and 1-phenyl-3-pyrazolidones or p-aminophenols is used, the amount of the former is preferably from 0.05 mol/liter to 0.5 mol/liter and the amount of the latter is 0.06 mol/liter or less.

The developer used in the present invention may contain amino compounds such as those described in Japanese Patent Application No. 1-29418.

A sulfite preservative may be used in the developer for use in the present invention, which includes, for example, sodium sulfite, potassium sulfite, lithium sulfite, ammonium sulfite, sodium bisulfite, potassium metabisulfite, and formaldehyde-sodium bisulfite. The concentration of such a sulfite preservative is preferably 0.4 mol/liter or more, especially preferably 0.5 mol/liter or more. The uppermost limit is preferably up to 2.5 mol/liter.

The developer for use in the present invention may contain an alkali agent for adjusting the pH value thereof. Such an alkali agent includes a pH adjusting agent and a buffer, such as sodium hydroxide, potassium hydroxide, sodium carbonate, potassium carbonate, sodium tertiary phosphate, and potassium tertiary phosphate. Accordingly, the pH value of the developer may be adjusted to fall within the range of from 10.5 to 12.3.

Other additives, which may be added to the developer, in addition to the above-mentioned components, are compounds such as boric acid or borax; a development inhibitor such as sodium bromide, potassium bromide or potassium iodide; an organic solvent such as ethylene glycol, diethylene glycol, triethylene glycol, dimethylformamide, methyl cellosolve, hexylene glycol, ethanol or methanol; and an antifoggant or a black pepper inhibitor such as indazole compounds (e.g., 1-phenyl-5-mercaptotetrazole, 5-nitroindazole) or benzotriazole compounds (e.g., 5-methylbenzotriazole). Additionally, the developer may further contain, if desired, a color toning agent, a surfactant, a defoaming agent, a water softener, a hardening agent, and amino compounds described in JP-A-56-106244.

The developer for use in the present invention can also contain compounds described in JP-A-56-24347, as a silver stain inhibitor. It can also contain compounds described in JP-A-61-267759 as a dissolution aid. Further, it can also contain compounds described in JP-A-

60-93433 and compounds described in JP-A-62-186259 as a pH buffering agent.

A fixer usable for processing the photographic material of the present invention is an aqueous solution containing, in addition to a fixing agent, a hardening agent (for example, water-soluble aluminium compounds) and acetic acid and a dibasic acid (for example, tartaric acid, citric acid or salts thereof). The fixer has a pH value of 3.8 or more, more preferably from 4.0 to 5.5.

The fixing agent to be in the fixer may be sodium thiosulfate and ammonium thiosulfate. Especially preferred is ammonium thiosulfate, as having a high fixing rate. The amount of the fixing agent in the fixer may vary. Generally, the amount of fixing agent is approximately from 0.1 to 0.5 mol/liter.

Water-soluble aluminium salts which are used in the fixer as a hardening agent are generally known as a hardening agent for use in an acidic film-hardening fixer. Examples of these salts are aluminium chloride, aluminium sulfate and potassium alum.

Examples of the above-mentioned dibasic acid are tartaric acid and derivatives thereof and citric acid and derivatives thereof, singly or in combination of two or more. The compound(s) are effectively contained in the fixer in an amount of 0.005 mol or more per liter of the fixer, especially preferably in an amount of from 0.01 mol/liter to 0.03 mol/liter.

Specific examples of the second compounds are tartaric acid, potassium tartarate, sodium tartarate, sodium potassium tartarate, ammonium tartarate, and potassium ammonium tartarate.

Effective examples of citric acid and derivatives thereof usable in the present invention are citric acid, sodium citrate, and potassium citrate.

The fixer may further contain, if desired, a preservative (for example, sulfites, bisulfites), a pH buffer (for example, acetic acid, boric acid), a pH adjusting agent (for example, ammonia, sulfuric acid), an image quality improving agent (for example, potassium iodide), and a chelating agent. As the pH value of the developer to be used prior to the fixer is high, the fixer may contain a pH buffering agent in an amount of from 10 to 50 g/liter, more preferably from 18 to 25 g/liter.

When the photographic material of the present invention is processed, the total processing time is from 15 seconds to 60 seconds. Accordingly, the material is well processable with an automatic developing machine by rapid processing.

In rapid processing of the photographic material of the present invention, the temperature and time for development and fixation are approximately from 25 to 50° C. and 25 seconds or less, preferably approximately from 30 to 40° C. and from 4 to 15 seconds, respectively.

After being developed and fixed, the photographic material of the present invention is rinsed in water or stabilized. The rinsing step may be effected by a 2-stage or 3-stage countercurrent rinsing system for economization of water used in the step. Where rinsing is effected with a small amount of water, it is preferred to provide a squeeze roller rinsing tank in the rinsing step. Further, a part or all of the overflow from the rinsing bath or stabilization bath may be recirculated to the fixing bath by the system described in JP-A-60-235133. By using such recirculation, the amount of waste liquid drained from the process may advantageously be reduced.

The rinsing water may contain a fungicide (for example, compounds described in Horiguchi, *Antibacterial and Antifungal Chemistry* and in JP-A-62-115154), a rinsing accelerator (for example, sulfites), and a chelating agent.

According to the above-mentioned process, the temperature and the time in the rinsing or stabilization bath are from 0° C. to 50° C. and from 5 seconds to 30 seconds, preferably from 15° C. to 40° C. and from 4 seconds to 20 seconds, respectively.

After being developed, fixed and rinsed, the photographic material of the present invention is then dried via a squeeze roller. The drying is effected at a temperature of from 40° C. to 80° C. and for a period of time of from 4 seconds to 30 seconds.

The total processing time for processing the photographic material of the present invention means all the time from insertion of the top of the film to be processed into the inlet of an automatic developing machine to taking-out of the top of the processed film from the outlet of the drying zone of the machine, via the developing tank, connecting line part, fixing tank, connecting line part, rinsing tank, connecting line part, and drying zone.

Next, the present invention will be explained in more detail by way of the following examples, which, however, are not intended to restrict the scope of the present invention.

EXAMPLE 1

An aqueous solution of silver nitrate and an aqueous solution containing potassium iodide and potassium bromide were simultaneously added to an aqueous gelatin solution kept at 50° C., in the presence of $4\times10^{-7}$ mol per mol of silver of potassium hexachloroiridate(III) and ammonia, over a period of 60 minutes, and the pAg value of the reaction system was kept at 7.8. Accordingly, a monodisperse cubic emulsion having a mean grain size of 0.28 μ and a mean silver iodide content of 1 mol % was prepared. The emulsion was then washed with water by an ordinary method to remove soluble salts therefrom, and gelatin was added thereto. Subsequently, 0.1 mol % per mol of silver of an aqueous solution of potassium iodide was added to the emulsion for effecting halogen conversion on the surfaces of the grains. Accordingly, Emulsion (A) was prepared.

To the Emulsion (A) were added $4.0\times10^{-5}$ mol/mol of Ag of Compound (1) (sensitizing dye), $4.0\times10^{-5}$ mol/mol of Ag of Compound (2) (sensitizing dye), $1.2\times10^{-3}$ mol/mol of Ag of Compound (3) (hydrazine and $5.0\times10^{-5}$ mol/mol of Ag of Compound (4) (hydrazine derivative derivative), in order. Further, 8 mg/m$^2$ of 4-hydroxy-6-methyl-1,3,3a,7-tetrazaindene (stabilizer), 600 mg/m$^2$ of polyethyl acrylate latex (grain size: 0.05 μ), 20 mg/m$^2$ of 5-methylbenzotriazole, 10 mg/m$^2$ of 1,4-bis[3-(4-acetylamino-pyridinio)propionyloxy]-tetramethylene dibromide, and 145 mg/m$^2$ of 2-bis(vinylsulfonylacetamido)ethane were added thereto. The resulting composition was then coated on a polyethylene terephthalate film having a thickness of 100 μ, in an amount of 3.5 g/m$^2$ as silver and 2.0 g/m$^2$ as gelatin.

Further, protective layers each having the following Composition (1) and Composition (2) were coated over the layer.

| Composition (1): | |
|---|---|
| Gelatin | 1.0 g/m$^2$ |
| L-ascorbic Acid | 30 mg/m$^2$ |
| Hydroquinone | 190 mg/m$^2$ |

-continued

| | |
|---|---|
| Polyethyl Acrylate Latex (mean grain size 0.05μ) | 240 mg/m² |
| Sodium Polystyrenesulfonate | 3 mg/m² |
| Composition (2): | |
| Gelatin | 6 g/m² |
| Fine Polymethyl Methacrylate Grains (mean grain size 2.5μ) | 60 mg/m² |
| Compound II-6 (gelatin dispersion) | 10 mg/m² |
| Sodium Dodecylbenzenesulfonate | 20 mg/m² |
| Potassium N-perfluorooctanesulfonyl-N-propylglycine | 4 mg/m² |
| Colloidal Silica (Snowtex C) | 90 mg/m² |

Next, a backing layer having the following Composition (3) was coated on the opposite surface, and a backing layer-protecting layer having the following Composition (4) was overcoated on the backing layer.

| | |
|---|---|
| Composition (3): | |
| Gelatin | 3 g/m² |
| Compound (5) | 60 mg/m² |
| Compound (6) | 90 mg/m² |
| Compound (7) | 80 mg/m² |
| Sodium Dihexyl-α-sulfosuccinate | 40 mg/m² |
| Sodium Dodecylbenzenesulfonate | 40 mg/m² |
| 1,3-Divinylsulfonyl-2-propanol | 120 mg/m² |
| Polyethyl Acrylate Latex (grain size 0.05μ) | 300 mg/m² |
| Composition (4): | |
| Gelatin | 0.8 g/m² |
| Sodium Dihexyl-α-sulfosuccinate | 15 mg/m² |
| Sodium Dodecylbenzenesulfonate | 15 mg/m² |
| Sodium Acetate | 40 mg/m² |
| Mat Agent | (see Table 1) |
| Lubricant Agent (Compound II-6) (gelatin dispersion) | 100 mg/m² |

Compounds used above are as follows:

Compound (1)

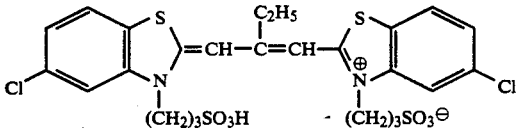

Compound (2)

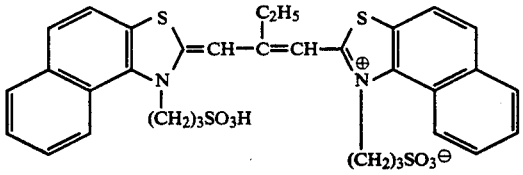

Compound (3)

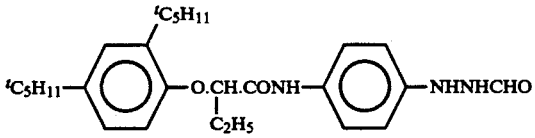

Compound (4)

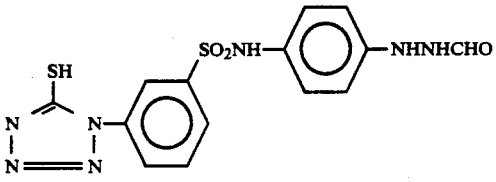

Compound (5)

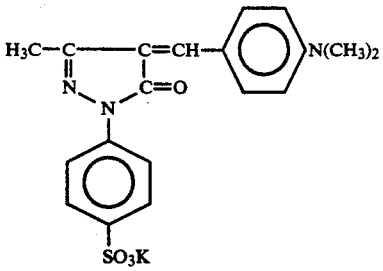

Compound (6)

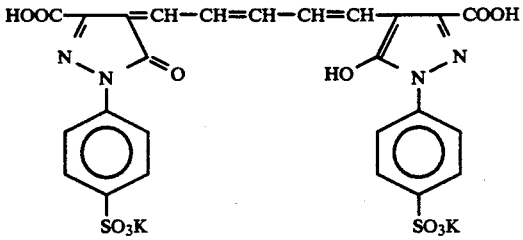

Compound (7)

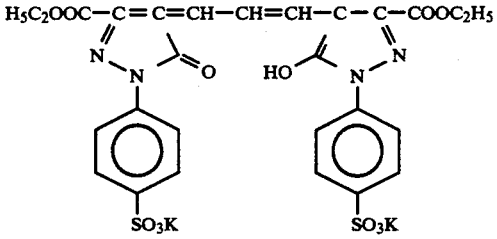

Each of Samples Nos. 1 to 17 thus prepared was cut into a size of 50 cm×50 cm, and 100 sheets of the thus cut sample were piled up and packaged in a polyethelene-coated paper bag under the condition of 25° C., 60% RH and a reduced pressure of 75 mmHg. The packaged sample bags were stored under no load (A) and under load of 5 kg/cm² (B) for 24 hours. For the test (B), the load was applied to the bag by the use a desk-top loading press. After the load test, the bag was opened, and immediately the sheet was transported from the bag by sucking up the edge thereof with a sucker one by one and the number of times of double-sucking were counted. ("Double-sucking" indicates that the next sheet is also sucked up together with the previously sucked sheet.)

Measurement of the grain size of the mat agent used was effected by the use of a laser diffraction grain size distribution measuring device, Master Siger (manufactured by MALVERN INSTRUMENTS Co.), and the grain size distribution was represented by percentage by volume.

Regarding haze, each non-exposed sample was processed with a developer GR-Dl (product by Fuji Photo Film Co.) and a fixer GR-Fl (product by the same), the development time being 30 seconds at a temperature of 34° C., and the haze of the thus processed sample was measured with a haze meter (manufactured by Nippon Denshoku KK). Haze is automatically metered, which is represented by the following formula:

$$Haze(\%)=(Scattered\ Light)/(Total\ Transmitted\ Light)\times 100$$

The smaller the haze value, the higher the transparency of the sample. The photographic material of the present invention is desired to have a high transparency or a small haze value.

The results of the feedability and haze value as obtained for Samples Nos. 1 to 17 are shown in Table 1 below.

As is noted from the results in Table 1, the comparative samples (Sample No. 17: this contained mat agent grains of JP-A-60-188942; Samples 2 and 4: these contained grains having a grain size of 15 μm or more in an amount of less than 5 vol %) could not have an improved feedability. Comparative Sample No. 5 (this contained a large amount of a mat agent to improve the feedability) had an extremely high haze value. As opposed to the such comparative samples, the samples of the present invention (Sample Nos. 3, 6 to 16: these contained a mat agent containing grains having a grain size of 15 μm or more in an amount of at least 5 vol%) had improved feedability without greatly increasing the haze value. Accordingly, the effect of the present invention is clear from these results.

TABLE 1

| Sample No. | Mat Agent Grains: Composition | Proportion of Grains with grain size of less than 15 μm (vol %) | Proportion of Grains Grains with grain size of 15 μm or more (vol %) | Amount Coated (mg/m²) | Times of Double-Sucking/100 sheets: (A) No Load | (B) Load of 5 Kg/m² | Haze (%) |
|---|---|---|---|---|---|---|---|
| 1 (comparative) | — | — | — | — | 23 | 25 | 10.3 |
| 2 (comparative) | Silicon Dioxide | 96.2 | 3.8 | 60 | 12 | 0 | 21.4 |
| 3 (invention) | Silicon Dioxide | 92.7 | 7.3 | 60 | 0 | 0 | 14.4 |
| 4 (comparative) | Polymethyl Methacrylate | 96.0 | 4.0 | 60 | 7 | 8 | 21.2 |
| 5 (comparative) | Polymethyl Methacrylate | 96.0 | 4.0 | 250 | 1 | 0 | 56.3 |
| 6 (invention) | Polymethyl Methacrylate | 92.2 | 7.8 | 10 | 0 | 1 | 12.1 |
| 7 (invention) | Polymethyl Methacrylate | 92.2 | 7.8 | 60 | 0 | 0 | 14.8 |
| 8 (invention) | Polymethyl Methacrylate | 92.2 | 7.8 | 250 | 0 | 0 | 30.7 |
| 9 (invention) | Benzoquanamine Resin | 92.4 | 7.6 | 60 | 0 | 0 | 15.1 |
| 10 (invention) | Polystyrene | 91.8 | 8.2 | 60 | 0 | 4 | 15.1 |
| 11 (invention) | Polystyrene | 92.2 | 7.8 | 60 | 0 | 5 | 14.6 |
| 12 (invention) | Poly(methyl methacrylate/ methacrylic acid) (9/1) | 92.5 | 7.5 | 10 | 1 | 1 | 12.1 |
| 13 (invention) | Poly(methyl methacrylate/ methacrylic acid) (9/1) | 92.5 | 7.5 | 60 | 0 | 0 | 15.0 |
| 14 (invention) | Poly(methyl methacrylate/ methacrylic acid) (9/1) | 92.5 | 7.5 | 250 | 0 | 0 | 30.9 |
| 15 (invention) | Poly(methyl methacrylate/ methacrylic acid) (6/4) | 92.2 | 7.8 | 60 | 0 | 0 | 11.7 |
| 16 (invention) | Starch | 91.9 | 8.1 | 60 | 0 | 0 | 15.2 |
| 17 (comparative) | Polymethyl Methacrylate | size 15 μm or more<br>size 10–14 μm<br>size 5–9.9 μm<br>size less than 5 μm | 3.1 vol %<br>9.0 vol %<br>52.1 vol %<br>35.8 vol % | 60 | 9 | 11 | 25.3 |

EXAMPLE 2

An aqueous silver nitrate solution and an aqueous solution containing 30 mol % per mol of silver of sodium bromide and sodium chloride containing $3\times10^{-7}$ mol per mol of silver of $K_3IrCl_6$ and $3\times10^{-7}$ mol silver of $(NH_4)_3RHCl_6$, were simultaneously added to an aqueous gelatin solution kept at 48° C., over a period of 30 minutes, and the potential in the reaction system was kept at 70 mV. Accordingly, a monodisperse silver chlorobromide emulsion having a mean grain size of 0.28 μ was prepared. To the emulsion was added 0.2 mol % per mol of silver of an aqueous potassium iodide solution for halogen conversion. Next, the resulting emulsion was desalted by flocculation. To the emulsion were added hypo and chloroauric acid for effecting chemical ripening at 60° C. Next, an aqueous 1% solution of 4-hydroxy-6-methyl-1,3,3a,7-tetrazaindene (stabilizer) was added to the emulsion in an amount of 30 ml per mol of silver.

To 1 kg of the emulsion was added 60 ml of 0.05% solution of an infrared sensitizing dye (D-2) for effecting infrared sensitization. Further, for effecting supersensitization and stabilization, 70 ml of 0.5% methanol solution of disodium 4,4'-bis(4,6-dinaphthoxypyrimidin-2-ylamino)stilbenedisulfonate and 90 ml of 0.5% methanol solution of 2,5-dimethyl-3-allyl-benzothiazol iodide were added to the emulsion. Additionally, $1.3\times10^{-3}$ mol/mol of silver of Compound (3) (hydrazine derivative; same compound as that used in Example 1), $5.3\times10^{-3}$ mol/mol of silver of Compound (4) (hydrazine derivative; same compound as that used in Example 1), 100 mg of hydroquinone, 25 % to gelatin binder of polyethyl acrylate latex (plasticizer), and 160 mg/m² of 2-bis(vinylsulfonylacetamido)ethane (hardening agent) were added to the emulsion. Then, the resulting emulsion was coated on a polyester support in an amount of 3.7 g/m² as silver. The amount of gelatin coated was 2.5 g/m².

An upper protective layer comprising 0.6 g/m² of gelatin, 60 mg/m² of polymethyl methacrylate (grain size: 3 to 4 μ mat agent), 70 mg/hu2 of colloidal silica (Snowtex C, grain size: 10 to 20 mμ, mat agent), 100 mg/m² of Compound (II-6), and sodium dodecylbenzenesulfonate (coating aid) and a fluorine-containing surfactant having the following structural formula (1); and a lower protective layer comprising 0.7 g/hu2 of gelatin, 225 mg/m² of polyethyl acrylate latex, 20 mg/m² of a dye having the following structural formula (2), 10 mg/m² of a dye having the following structural formula (3), and sodium dodecylbenzenesulfonate (coating aid) were simultaneously coated over the previously coated emulsion layer.

Surfactant (1)

$C_8F_{17}SO_2N(C_3H_7)-CH_2COOK$

Dye (2)

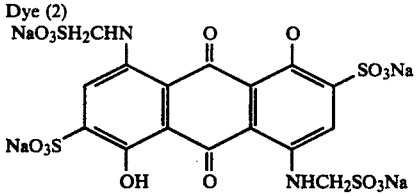

Dye (3)

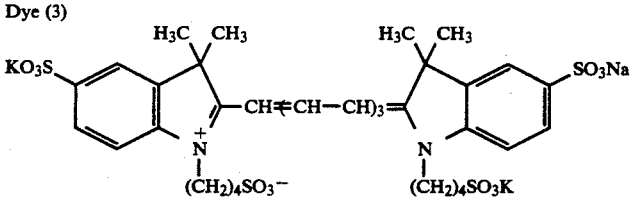

Next, a backing layer having the composition mentioned below was coated on the opposite surface, and a backing layer-protecting layer was then coated thereover with varying the mat agent as indicated in Table 2 below.

| Backing Layer: | |
|---|---|
| Gelatin | 3.0 g/m² |
| Sodium Dodecylbenzenesulfonate | 80 mg/m² |
| Dye (3) (illustrated above) | 80 mg/m² |
| Dye (4) (illustrated below) | 30 mg/m² |
| Dye (5) (illustrated below) | 100 mg/m² |
| 1,3-Divinylsulfonyl-2-propanol | 60 mg/m² |
| Potassium Polyvinyl-benzenexulfonate | 30 mg/m² |

Dye (4)

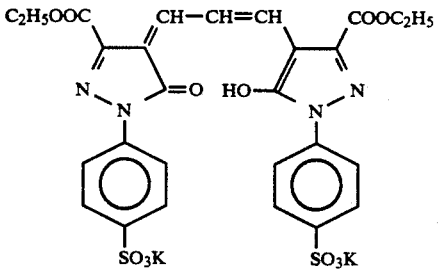

Dye (5)

-continued

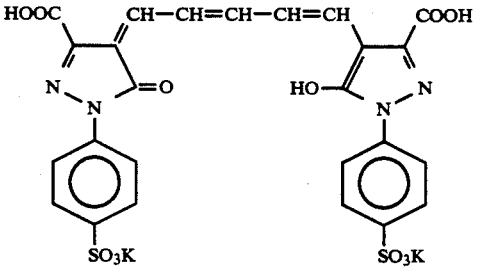

| Backing Layer-Protecting Layer: | |
|---|---|
| Gelatin | 0.75 g/m² |
| Mat Agent | (see Table 2) |
| Sodium Dodecylbenzenesulfonate | 20 mg/m² |
| Fluorine-containing Surfactant (Compound (1) mentioned above) | 2 mg/m² |
| Lubricant Agent (Compound II-6) (gelatin dispersion) | 100 mg/m² |

Each of the thus prepared samples were processed in the same way as in Example 1 and then evaluated with respect to the feedability and haze also in the same way as in Example 1. The results obtained are shown in Table 2 below.

As is noted from the results in Table 2, the samples of the present invention (Samples Nos. 24 and 26 to 33) had improved feedability and a small haze valve. From these results, the effect of the present invention is clear.

TABLE 2

| Sample No. | Mat Agent Grains: Composition | Proportion of Grains with grain size of less than 15 μm (vol %) | Proportion of Grains Grains with grain size of 15 μm or more (vol %) | Amount Coated (mg/m²) | Times of Double-Sucking/100 sheets: (A) No Load | (B) Load of 5 Kg/m² | Haze (%) |
|---|---|---|---|---|---|---|---|
| 21 (comparative) | — | — | — | — | 21 | 23 | 9.5 |
| 22 (comparative) | Silicon Dioxide | 95.9 | 4.1 | 50 | 11 | 13 | 19.3 |
| 23 (comparative) | Silicon Dioxide | 95.9 | 4.1 | 100 | 1 | 2 | 28.7 |
| 24 (invention) | Silicon Dioxide | 92.4 | 7.6 | 50 | 0 | 0 | 12.2 |
| 25 (comparative) | Polymethyl Methacrylate | 95.8 | 4.2 | 50 | 8 | 9 | 18.0 |
| 26 (invention) | Polymethyl Methacrylate | 91.8 | 8.2 | 50 | 0 | 0 | 12.0 |
| 27 (invention) | Polymethyl Methacrylate | 83.4 | 16.6 | 50 | 0 | 0 | 11.6 |
| 28 (invention) | Benzoguanamine Resin | 92.4 | 7.6 | 50 | 0 | 0 | 11.8 |

TABLE 2-continued

| Sample No. | Mat Agent Grains: Composition | Proportion of Grains with grain size of less than 15 μm (vol %) | Proportion of Grains Grains with grain size of 15 μm or more (vol %) | Amount Coated (mg/m²) | Times of Double-Sucking/100 sheets: (A) No Load | (B) Load of 5 Kg/m² | Haze (%) |
|---|---|---|---|---|---|---|---|
| 29 (invention) | Polystyrene | 91.8 | 8.2 | 50 | | 3 | 12.5 |
| 30 (invention) | Polystyrene | 92.2 | 7.8 | 50 | 0 | 6 | 12.5 |
| 31 (invention) | Poly(methyl methacrylate/ methacrylic acid) (9/1) | 92.5 | 7.5 | 50 | 0 | 0 | 13.0 |
| 32 (invention) | Poly(methyl methacrylate/ methacrylic acid) (6/4) | 92.2 | 7.8 | 50 | 0 | 0 | 10.8 |
| 33 (invention) | Stearch | 92.3 | 7.7 | 50 | 0 | 0 | 12.1 |

EXAMPLE 3

Photographic material samples (Samples Nos. 41 to 45) were prepared in the same manner as in Example 2, except that the composition of the mat agent grains in each sample was varied as indicated in Table 3 below. These were processed and evaluated with respect to the feedability and haze in the same manner as in Example 1. Additionally, the pressure resistance of each sample was evaluated as described below. The results obtained are shown in Table 3.

Evaluation of the pressure resistance was effected, using the sample to which a load of 5 kg/cm² was applied. After the load was applied to each sample, the degree of deformation, if any, of the mat agent grains in the sample was observed with an optical microscope. The pressure resistance was evaluated on the basis of the following five ranks.

A=Most grains crushed noticeably.
C=Some grains crushed.
E=Almost no grains crushed.
B=Intermediate between A and C.
D=Intermediate between C and E.

TABLE 3

| Sample No. | Mat Agent Grains: Composition | Rockwell Hardness $H_R$ M(*) | Proportion of Grains Grains with grain size of 15 μm or more (%) | Amount Coated (mg/m²) | Times of Double-Sucking/100 sheets: (A) No Load | (B) Load of 5 Kg/m² | Deformation under Load | Haze (%) |
|---|---|---|---|---|---|---|---|---|
| 41 | Melamine Resin | 125 | 7.5 | 60 | 0 | 0 | E | 14.3 |
| 42 | Polymethyl Methacrylate | 99 | 8.1 | 60 | 0 | 0 | E | 14.5 |
| 43 | Polyethyrene | 82 | 7.6 | 60 | 0 | 4 | C | 14.5 |
| 44 | Hard Polyvinyl Chloride | 80 | 7.8 | 60 | 0 | 5 | B | 15.1 |
| 45 | Polypropylene | 65 | 8.0 | 60 | 0 | 7 | A | 14.4 |

(*) Rockwell hardness was measured by a load test using a ⅛in. steel ball under load of 100 kgf.

From the results in Table 3 above, it is noted that the mat agent grains of melamine resin or polymethyl methacrylate, which is hard to have a Rockwell hardness ($_{HR}$M) of more than 85, did not crush under load so that the samples having such mat agent grains were free from double-sucking accident in transporting the sheets. As opposed to them, however, the mat agent grains of polystyrene, polyvinyl chloride or polypropylene, which has a Rockwell hardness ($H_R$ M) of less than 85, crushed under load so that the samples having such mat agent grains caused the double-sucking accident in transporting the sheets.

EXAMPLE 4

Preparation of Surface-Treated Synthetic Resin Grains 100 g of a powder of polymethyl methacrylate grains, in which the proportion of grains having a grain size of 15 μm or more was 8.0% by volume, was dispersed in 300 ml of 0.05 N NaOH (3-a); or was dispersed in 300 ml of 0.2 N NaOH (3-b). Each suspension was gently stirred for 60 minutes with heating up to 50° C. This was neutralized with 1 N $NH_2SO_4$ and then allowed to stand quietly as it was for one full day, and the separated supernatant was removed. 2000 ml of a distilled water was added to the residue and well stirred, and the resulting suspension was again allowed to stand quietly as it was for one full day, and the separated supernatant was removed. The washing step was repeated three times and then the finally precipitated polymethyl methacrylate grains were taken out and dried. On the other hand, 100 g of a powder of polystyrene grains, in which the proportion of grains having a grain size of 20 μm or more was 8.5% by volume, was dispersed in 300 ml of 0.05 N NaOH (3-d). Each suspension was gently stirred for 60 minutes with heating up to 50° C. This was washed with water and neutralized in the same way as above, to obtain surface-treated polystyrene grains.

Test of Precipitation of Mat Agent Grains in Liquid Compositions for Coating Backing Layer-Protecting Layer Liquid Composition samples (Samples Nos. 101 to 106) for coating a backing layer-protecting layer were prepared from the following components.

| | |
|---|---|
| Gelatin | 7.5 wt. % |
| Mat Agent (see Table 4) | 0.35 wt. % |
| Sodium Dodecylbenzenesulfonate | 0.2 wt. % |
| Fluorine-containing Surfactant (Compound (1) mentioned above) | 0.02 wt. % |

-continued

| | |
|---|---|
| Compound (II-6) (gelatin dispersion) | 1.0 wt. % |
| Water | 90.93 wt. % |

The liquid coating composition was put in a 500 ml container and allowed to stand as it was for 24 hours at 35° C. without stirring, and the supernatant as separated was removed. The precipitated grains were washed with water and subjected to centrifugation to remove superfluous organic substances and salts, and then dried. The dry weight of the grains was measured. The results obtained are shown in Table 4 below.

TABLE 4

| Sample No. | Mat Agent Grains: Composition | Proportion of Grains with grain size of 15 μm or more (%) | Weight of grains precipitated (g) |
|---|---|---|---|
| 101 | Non-treated Polymethyl Methacrylate | 8.0 | 1.55 |
| 102 | Polymethyl Methacrylate (3-a) | 8.0 | 0.33 |
| 103 | Polymethyl Methacrylate (3-b) | 8.0 | 0.26 |
| 104 | Non-treated Polystyrene | 8.5 | 1.32 |
| 105 | Polystyrene (3-c) | 8.5 | 0.28 |
| 106 | Polystyrene (3-d) | 8.5 | 0.19 |

From the results in Table 4 above, it is noted that the weight of the grains as precipitated in the liquid coating composition noticeably decreased in the Samples Nos. 102, 103, 105 and 106, each containing alkali-processed grains, as compared with the other samples containing non-treated grains.

Next, photographic material samples (Samples Nos. 61 to 69) were prepared in the same manner as in Example 2, except that the grains as prepared in the present Example 4 were incorporated into the backing layer-protecting layer as a mat agent as indicated in Table 5 below. These samples were then evaluated in the same manner as in Example 1. The results obtained are shown in Table 5.

From the results in Table 5, it is noted that the samples containing the alkali-treated grains as a mat agent also had improved feedability. From the results, the effect of the present invention is clear.

TABLE 5

| Sample No. | Mat Agent Grains: Composition | Proportion of Grains with grain size of 15 μm or more (%) | Amount Coated (mg/m²) | Times of Double-Sucking/100 sheets |
|---|---|---|---|---|
| 61 (comparative) | — | — | — | 22 |
| 62 (comparative) | Non-treated Polymethyl Methacrylate | 3.6 | 60 | 10 |
| 63 (invention) | Non-treated Polymethyl Methacrylate | 8.0 | 60 | 0 |
| 64 (invention) | Polymetyl Methacrylate (3-a) | 8.0 | 60 | 0 |
| 65 (invention) | Polymetyl Methacrylate (3-b) | 8.0 | 60 | 0 |
| 66 (comparative) | Non-treated Polymethyl | 3.8 | 60 | 8 |
| 67 (invention) | Non-treated Polymethyl | 8.5 | 60 | 0 |
| 68 (invention) | Polystyrene (3-c) | 8.5 | 60 | 0 |
| 69 (invention) | Polystyrene (3-d) | 8.5 | 60 | 0 |

EXAMPLE 5

A silver halide emulsion layer, an upper protective layer and a lower protective layer were coated on a support in the same manner as in Example 2.

Next, a backing layer, to which polymethyl methacrylate grains (3-b) prepared in Example 4 had been added as a mat agent, was coated on the opposite surface of the support. Additionally, gelatin was coated thereon, in the thickness indicated in Table 6. A Lubricant agent and colloidal silica were added as indicated in Table 6.

| Backing Layer: | |
|---|---|
| Gelatin | 0.75 g/m² |
| Polymethyl Methacrylate Grains (3-b) | (see Table 6) |
| Sodium Dodceylbenzenesulfonate | 10 mg/m² |
| Sodium Dihexyl-α-sulfosuccinate | 7 mg/m² |
| Sodium Acetate | 30 mg/m² |
| Potassium Polystyrenesulfonate | 5 mg/m² |
| 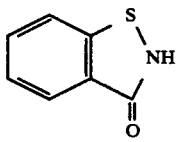 | 2 mg/m² |

| Backing Layer-Protecting Layer: | |
|---|---|
| Gelatin | amount to form a layer having thickness as shown in Table 6 |
| Polymethyl Methacrylate (mean grain size 3.4μ) | 20 mg/m² |
| Dye (3) (same as that in Example 2) | 70 mg/m² |
| Dye (4) (same as that in Example 2) | 35 mg/m² |
| Dye (5) (same as that in Example 2) | 95 mg/m² |
| Sodium Dodecylbenzenesulfonate | 35 mg/m² |
| Sodium Dihexyl-α-sulfosuccinate | 25 mg/m² |
| Potassium N-perfluorooctanesulfonyl-N-propylglycine | 2 mg/m² |
| Acetic Acid | 10 mg/m² |

-continued

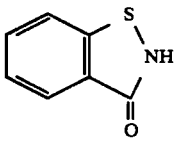

| | |
|---|---|
| | 2 mg/m$^2$ |
| 1,3-Divinylsulfonyl-propanol | 150 mg/m$^2$ |
| Polyethyl Acrylate Latex (grain size 0.05μ) | 500 mg/m$^2$ |

The thus prepared photographic material samples (Samples No. 70 to 84) were evaluated with respect to the feedability, in the same manner as in Example 1.

In addition, the same samples were attached to each other with the emulsion layer surface of one sample facing the backing layer surface of the other one, and the two were rubbed against each other under a certain load whereupon generation of fog, if any, of the rubbed emulsion layer was checked. On the basis of the degree of fog on the surface, the rubbing resistance was evaluated.

In the test, the samples were developed with an automatic developing machine FG-710NH Model (manufactured by Fuji Photo Film Co.), using an automatic developer GR-Dl (product by Fuji Photo Film Co.) and a fixer GR-Fl (Product by the same), and the developing temperature was 38° C. and the developing time was 20 seconds. Dropping out of the mat agent from each sample, if any, was evaluated, by rubbing the back surface of each sample with a cotton cloth under a load of 200 g/cm$^2$, and the amount of white powder (mat agent powder) generated by rubbing was measured. The results obtained are shown in Table 6 below. Measurement of the grain size of the mat agent was effected by means of an He-Ne laser ray diffraction method (using Master Siger, manufactured by MALVERN INSTRUMENTS Co.), and the grain size distribution was represented by percentage by volume. As is clear from the results shown in Table 6, the samples of the present invention were free from dropping out of mat agent grains and were also free from generation of rubbing fog. From the results, it is clear that the feedability of the samples of the present invention was satisfactorily improved.

(TABLE 6)

| Sample No. | Mat Agent in Backing Layer: mean grain size (μm) | Mat Agent in Backing Layer: Proportion of Grains with grain size of 15 μm or more (vol %) | Mat Agent in Backing Layer: Amount Coated (mg/m$^2$) | Backing Layer-Protecting Layer: Thickness (μm) | Backing Layer-Protecting Layer: Lubricating Agent (mg/m$^2$) | Backing Layer-Protecting Layer: Colloidal Silica (mg/m$^2$) | Time of Double-Sucking/ 100 sheets | Rubbing Fog | Droping-out of Mat Agent Grains (*) |
|---|---|---|---|---|---|---|---|---|---|
| 70 (comparative) | 8.0 | 4 | 40 | 8.0 | — | — | 10 | No | C |
| 71 (reference) | 9.0 | 10 | 40 | 0.5 | — | — | 0 | No | C |
| 72 (invention) | 9.0 | 10 | 40 | 1.0 | — | — | 0 | No | B |
| 73 (invention) | 9.0 | 10 | 40 | 2.0 | — | — | 0 | No | A |
| 74 (invention) | 9.0 | 10 | 40 | 3.0 | — | — | 0 | No | A |
| 75 (reference) | 10.0 | 15 | 40 | 0.5 | — | — | 0 | No | C |
| 76 (invention) | 10.0 | 15 | 40 | 1.0 | — | — | 0 | No | B |
| 77 (invention) | 10.0 | 15 | 40 | 2.0 | — | — | 0 | No | A |
| 78 (invention) | 10.0 | 15 | 40 | 3.0 | — | — | 0 | No | A |
| 79 (reference) | 12.0 | 20 | 40 | 1.0 | — | — | 0 | No | C |
| 80 (invention) | 12.0 | 20 | 40 | 2.0 | — | — | 0 | No | A |
| 81 (invention) | 12.0 | 20 | 40 | 3.0 | — | — | 0 | No | A |
| 82 (invention) | 12.0 | 20 | 40 | 1.2 | (II-6) 50 | — | 0 | No | B |
| 83 (invention) | 12.0 | 20 | 40 | 1.2 | — | 200 | 0 | No | B |
| 84 (comparative) | — | — | — | 2.0 | — | — | 23 | No | not measured |

(*) Evaluation:
A: None
B: Little
C: Some or Remarkable

EXAMPLE 6

The same light-sensitive layer as that used in Example 5 was coated on one surface of a biaxially stretched polyethylene terephthalate film support (thickness: 100 μm), and the same two protective layers as those in Example 5 were coated thereover. On the opposite surface, an electroconductive layer having the composition described below was coated, and the same backing layer and backing layer-protecting layer as those in Sample Nos. 73, 77 and 80 in Example 5 were coated on the electroconductive layer in order.

| Electroconductive Layer: | |
|---|---|
| $SnO_2$/Sb (9/1, by weight, mean grain size: 0.25μ) | 300 mg/m$^2$ |
| Gelatin | 170 mg/m$^2$ |
| 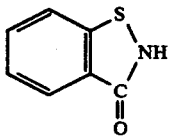 | 7 mg/m$^2$ |
| Sodium Dodecylbenzenesulfonate | 10 mg/m$^2$ |
| Sodium Dihexyl-α-sulfosuccinate | 40 mg/m$^2$ |
| Sodium Polystyrenesulfonate | 9 mg/m$^2$ |

(*) Surface resistance of electroconductive layer (25° C., 25% RH) was $2 \times 10^{10}$ Ω.

The thus prepared samples were evaluated with respect to feedability and rubbing resistance (or dropping-out resistance of mat agent grains and fogging-resistance under rubbing condition), in the same way as in Example 5. As a result, all the samples of the present invention showed improved feedablity and rubbing resistance, as being free from dropping out of mat agent grains and from rubbing fog.

EXAMPLE 7

4-Hydroxy-6-methyl-1,3,3a,7-tetrazaindene (stabilizer) was added to a silver chlorobromide emulsion (Br 1 mol %, means grain size 0.2 μ) containing $1\times10^{-5}$ mol per mol of silver of rhodium, without the emulsion being chemically ripened. A tetrazolium salt having the following formula:

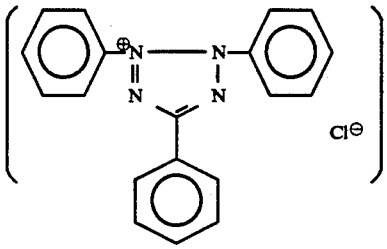

was added to the emulsion in an amount of $5\times10^{-3}$ mol per mol of silver. Further, 0.9 g/m² of ethyl acrylate latex (means grain size 0.05 μ) and 100 mg/m² of 1,2-(vinylsulfonylacetamido)ethane were added thereto. The resulting emulsion was coated on one surface of a biaxially stretched polyethylene terephthalate film support (thickness: 100 μm) in an amount of 3.9 g/m² as silver. The amount of gelatin coated was 3.1 g/m². The same two protective layers as those in Example 5 were coated on the emulsion layer in the same order. The same electroconductive layer, backing layer and protecting layer as those in Example 6 were coated on the opposite surface.

The photographic material samples thus prepared were evaluated with respect to feedability and rubbing resistance (or dropping-out resistance of mat agent grains and fogging-resistance under rubbing condition), in the same way as in Example 5. As a result, all the samples of the present invention showed improved feedability and rubbing resistance, as being free from dropping out of mat agent grains and from rubbing fog.

In the present example, the samples were developed with a developer having the following composition.

| Developer: | |
|---|---|
| Disodium Ethylenediamine-tetraacetate (dihydrate) | 0.75 g |
| Potassium Sulfite Anhydride | 51.7 g |
| Potassium Carbonate Anhydride | 60.4 g |
| Hydroquinone | 15.1 g |
| 1-Phenyl-3-pyrazolidone | 0.51 g |
| Sodium Bromide | 2.2 g |
| 5-Methylbenzotriazole | 0.124 g |
| 1-Phenyl-5-mercaptotetrazole | 0.018 g |
| 5-Nitroindazole | 0.106 g |
| Diethylene Glycol | 98 g |
| Water to make | 1 liter |
| pH | 10.5 |

Because the silver halide photographic material of the present invention has a backing layer containing a mat agent containing grains having a grain size of 15 μm or more in a proportion of 5% by volume or more, the feedability of the material is improved without increasing the haze thereof. The effect of the present invention is clear from the results shown in the above-mentioned examples.

While the invention has been described in detail and with reference to specific embodiments thereof, it will be apparent to one skilled in the art that various changes and modifications can be made therein without departing from the spirit and scope thereof.

What is claimed is:

1. A silver halide photographic material having on one surface of a support at least one silver halide emulsion layer and having on the other surface of the support, a backing layer containing a mat agent, wherein the mat agent comprises grains having a grain size of 15 μm or more in a proportion of at least 5% by volume and the surfaces of the mat agent grains have been modified with an alkali.

2. A silver halide photographic material as in claim 1, wherein the mat agent grains have a Rockwell hardness of $H_R$ M85 or more.

3. A silver halide photographic material as in claim 1, wherein at least one light-insensitive hydrophilic colloid layer is formed over the layer containing the mat agent.

4. A silver halide photographic material as in claim 3, wherein the total thickness of the light-insensitive hydrophilic colloid layer formed over the layer containing the mat agent is 1/10 or more of the mean grain size of the mat agent grains.

5. A silver halide photographic material as in claim 1, wherein an outermost backing layer contains a lubricant agent, a colloidal silica, or both a lubricant agent and a colloidal silica.

6. A silver halide photographic material as in claim 5, wherein the lubricant agent is an alkylpolysiloxane represented by formula (I):

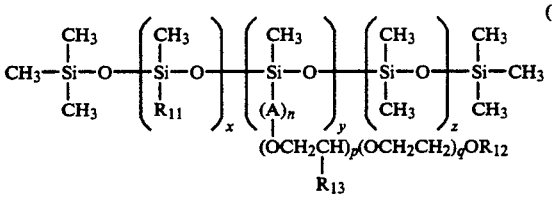

(I)

where $R_{11}$ represents an aliphatic group or an aryl group; $R_{12}$ represents a hydrogen atom, an aliphatic group or an aryl group; $R_{13}$ represents an alkyl group or an alkoxyalkyl group; A represents a divalent aliphatic hydrocarbon radical; n is 0 or an integer of from 1 to 12; p is 0 or an integer of from 1 to 50; q is an integer of from 2 to 50; x is 0 or an integer of from 1 to 100; y is an integer of from 1 to 50; z is 0 or an integer of from 1 to 100; and (x+y+z) is from 5 to 250.

7. A silver halide photographic material as in claim 5, wherein the lubricant agent is an alkylpolysiloxane represented by formula (II):

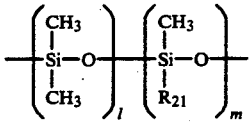

(II)

where $R_{21}$ represents an alkyl, cycloalkyl, alkoxyalkyl, arylalkyl, aryloxyalkyl or glycidylalkyl group having from 5 to 20 carbon atoms; l is 0 or an integer of 1 or more; m is an integer of 1 or more; and (l+m) is an integer of from 1 to 1000.

8. A silver halide photographic material as in claim 5, wherein the lubricant agent is an alkylpolysiloxane represented by formula (III):

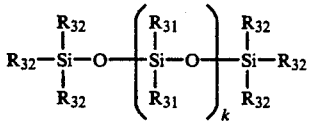

(III)

where $R_{31}$ represents an alkyl group having from 1 to 3 carbon atoms; $R_{32}$ represents an alkyl group having from 1 to 3 carbon atoms or an alkoxy group having 1 or 2 carbon atoms; and k is 0 or an integer from 1 to 2000.

9. A silver halide photographic material as in claim 5, wherein the lubricant agent is a liquid paraffin which is liquid at room temperature.

10. A silver halide photographic material as in claim 1, wherein a hydrazine derivative or at tetrazolium compound is present in the silver halide emulsion layer(s) or in an adjacent layer(s).

11. A silver halide photographic material as in claim 10, wherein the tetrazolium compound is 2-benzothiazol-2-yl)-3-phenyl-5-dodecyl-2H-tetrazolium bromide, 2,3-diphenyl-5-(4-t-octyloxyphenyl)-2H-tetrazolium chloride, 2,3,5-triphenyl-2H-tetrazolium, 2,3,5-tri(p-carboxyethylphenyl)-2H-tetrazolium, or 2-(benzothiazol-2-yl)-3-phenyl-5-(o-chlorophenyl)-2H-tetrazolium.

12. The silver halide photographic material as in claim 10, wherein the hydrazine derivative is a compound represented by formula (V):

(V)

where $R_{51}$ represents an aliphatic group or an aromatic group; $R_{52}$ represents a hydrogen atom, an alkyl group, an aryl group, an alkoxy group, an aryloxy group, an amino group, or a hydrazino group; V represents a —CO— group, a —$SO_2$— group, a —SO— group, a —PO($R_{53}$)— group, a —CO—CO— group, a thiocarbonyl group or an iminomethylene group; $R_{53}$ represents a group as defined for $R_{52}$; both $B_1$ and $B_2$ are hydrogen atoms, or one of them represents a hydrogen atom and the other represents a substituted or unsubstituted alkylsulfonyl group, a substituted or unsubstituted arylsulfonyl group, or a substituted or unsubstituted acyl group.

13. A silver halide photographic material as in claim 1, wherein an outer most backing layer contains an alkylpolysiloxane represented by formula (I) or formula (II):

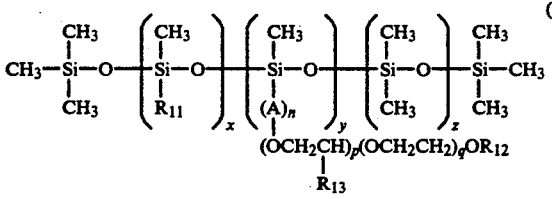

(I)

wherein $R_{11}$ represents an aliphatic group or an aryl group; $R_{12}$ represents a hydrogen atom, an aliphatic group or an aryl group; $R_{13}$ represents an alkyl group or an alkoxyalkyl group; A represents a divalent aliphatic hydrocarbon radical; n is 0 or an integer of from 1 to 12; p is 0 or an integer of from 1 to 50; q is an integer of from 2 to 50; x is 0 or an integer of from 1 to 100; y is an integer of from 1 to 50; z is 0 or an integer of from 1 to 100; and (x+y+z) is from 5 to 250.

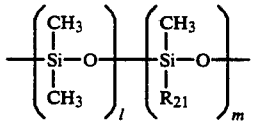

(II)

where $R_{21}$ represents an alkyl, cycloalkyl, alkoxyalkyl, arylalkyl, aryloxyalkyl or glycidylalkyl group having from 5 to 20 carbon atoms; l is 0 or an integer of 1 or more; m is an integer of 1 or more; and (l+m) is an integer of from 1 to 1000.

* * * * *